United States Patent [19]

Clark

[11] Patent Number: 4,651,060

[45] Date of Patent: Mar. 17, 1987

[54] METHOD AND APPARATUS FOR DIMMING FLUORESCENT LIGHTS

[75] Inventor: Ruel Clark, Bluffdale, Utah

[73] Assignee: Electro Controls Inc., Salt Lake City, Utah

[21] Appl. No.: 797,653

[22] Filed: Nov. 13, 1985

[51] Int. Cl.[4] ..... H05B 37/02

[52] U.S. Cl. ..... 315/199; 315/194; 315/307; 315/DIG. 2; 315/DIG. 4; 315/DIG. 7

[58] Field of Search ..... 315/194, 199, DIG. 4, 315/307, DIG. 2, DIG. 7

[56] References Cited

U.S. PATENT DOCUMENTS

| | | | |
|---|---|---|---|
| 3,611,024 | 10/1971 | Tondabayashi-Shi et al. | 315/205 |
| 3,927,345 | 12/1975 | Licata et al. | 315/DIG. 5 |
| 4,170,747 | 10/1979 | Holmes | 315/307 |
| 4,207,498 | 6/1980 | Spira et al. | 315/97 |
| 4,220,895 | 9/1980 | Nuver | 315/DIG. 7 |
| 4,286,195 | 8/1981 | Swinen, Jr. | 315/224 |
| 4,287,468 | 9/1981 | Sherman | 323/322 |
| 4,358,716 | 11/1982 | Cordes et al. | 315/306 |
| 4,471,269 | 9/1984 | Ganser et al. | 315/307 |
| 4,495,445 | 1/1985 | Turney | 315/169.1 |

OTHER PUBLICATIONS

Luciano D. Fraia, "A Method to Achieve Continuous Dimming of Low Pressure Sodium and Other Gas Discharge Lamps" Journal of IES, Jul. 1981, pp. 245-252.

*Primary Examiner*—Harold Dixon

*Attorney, Agent, or Firm*—Mallinckrodt & Mallinckrodt

[57] ABSTRACT

A dimmer for fluorescent lights utilizes a standard A.C. phase control at normal line A.C. frequencies to control the line power to the standard fluorescent light ballast and thereby control the illumination level of the light. During the "off" time of the A.C. line signal, a high frequency signal is applied to the ballast which supplies additional power through the ballast to the filament of the light but is substantially blocked by the ballast from the discharge portion of the light so does not substantially affect the illuminating output of the light.

21 Claims, 18 Drawing Figures

METHOD AND APPARATUS FOR DIMMING FLUORESCENT LIGHTS

BACKGROUND OF THE INVENTION

1. Field

The invention is in the field of dimmers for, and methods of, variably dimming fluorescent lights.

2. State of the Art

Continuous dimming of electrical lamps of all types can be desirable for a number of reasons. It can change the atmosphere of a room or, from a more practical standpoint, the power to the lamps of a lighting system can initially be reduced to a desired illumination level to save energy and then increased during use of the system up to full value to compensate for illuminance losses caused by lamp lumen depreciation, dirt effects, and other light loss factors. It is also desirable sometimes to adjust the illumination output of a system depending on the varying natural light conditions.

The dimming of fluorescent lamps present problems because upon start-up of a fluorescent lamp, a large voltage is required to turn the lamp on by initiating the electrical arc in the tube. However, once started, the lamp's resistance decreases and if the current to the arc is not limited, the lamp would draw excessive current damaging various components of the electrical supply system and possibly causing the lamp to explode. The current regulation is generally accomplished by the standard inductive ballasts used with most fluorescent lamps which provides two windings, one for the high voltage arc discharge portion of the lamp and a separate winding for the lower voltage filament portion of the lamp. The high voltage winding has an air gap which limits current flow in the lamp. The filament winding is a normal transformer winding without air gap.

Phase control dimmers where energy to the load is controlled by varying the firing angle or "on" time of each half cycle of the A.C. supply power are commonly used to dim incandescent lamps. However, while such dimmers when used in conjunction with standard fluorescent lamps using standard lamp ballasts can satisfactorily control the energy to the high voltage portion of the lamps, at low levels of applied power (large A.C firing angles), it does not provide sufficient power to the filaments of the lamps and it has been found that fluorescent lamp life is materially shortened. Therefore, phase control dimmers are not used for fluorescent lamp dimming.

Fluorescent lamp dimmers currently available generally use special ballasts for the lamp so that the filament is supplied its required power while power, either the voltage or current, or both are reduced to the discharge portion of the lamp to control brightness. A major drawback of all dimming systems using special ballasts is that all of the normal ballasts have to be replaced with the special ballasts in order to dim the lamps involved. This can get very expensive.

It has been suggested that gas discharge lamps, such as the standard fluorescent lamps, may be dimmed by varying the frequency of the power to the lamps. The basis of such dimming is that as the frequency is increased, the power transferred through the air gap in the high voltage winding of the ballast decreases. Since the filament portion of the ballast has no air gap, it is not frequency sensitive so the power supplied to the filament remains at an acceptable level. This type of dimming system has the problem that variable frequency controls are expensive and inefficient. It also produces a high level of noise when switching transistors are used.

A need still exists for a dimmer for fluorescent lighting systems wherein the standard ballasts can be used eliminating the expense of new electronic ballasts, and which provides good dimming control over a wide illumination range while maintaining the filament voltage at an acceptable level.

SUMMARY OF THE INVENTION

According to the invention, a dimmer for fluorescent light utilizes a standard A.C. phase at normal 50 to 60 cycle frequency which controls the line power to the high voltage discharge portion of the light and to the filament and during the "off" time of the 50 to 60 cycle A.C., provides a high frequency signal which is passed through the filament winding of the ballast to supplement the line voltage to maintain required power to the filament, but which is substantially blocked by the high voltage winding of the ballast so only partially, if not all, appears at the discharge portion of the light. In this way, satisfactory power is maintained for the filament, but the power to the discharge portion of the light is substantially controlled by the phase angle of the normal A.C. to thereby control brightness.

The A.C. phase control controls the transmission of the normal line A.C. voltage sine wave to the normal fluorescent light ballast so that the A.C. voltage is connected to the ballast for only a selectable period of time during each half cycle of the sine wave and is blocked during the remaining portion of the sine wave. This phase control is preferably accomplished using semiconductor switches such as SCR's or a triac which remain "off" or "nonconducting" during a first portion of the A.C. sine wave and are then triggered "on" and remain "on" or "conductive" for the remainder of the half cycle. The relative "off" and "on" times establish the effective power supplied to the lights and control the brightness of the lights.

During at least a portion of "off" time of the line A.C. signal, a high frequency signal, such as a 16 KHz square wave is supplied to the ballast. Because of the normal characteristics of the ballast, the high frequency signal, which may be any frequency above about 1 KHz, is passed to the filament portion of the light but is substantially blocked from the discharge portion of the light.

The circuitry of the dimmer preferably also includes safety features to disconnect the high frequency signal in the event of excessive current, in the event the peak-to-peak voltage value of the high frequency signal drops substantially below the peak-to-peak voltage value of the line A.C. signal, and in the event of an imbalance between the positive and negative peak voltage values of the high frequency signal. The circuitry also preferably disconnects all power from the circuitry to the ballast when the line voltage drops below a present minimum as when the circuit is adjusted to dim the lights to a point where flicker of the light would occur. Further, circuitry may be provided to sense the light level in a room and control the dimming of the lights to provide a constant, preset illumination level.

The invention also includes the method of dimming fluorescent lights by applying a phase controlled A.C. signal of normal line frequency to the standard light ballast and inserting a high frequency signal during the "off" time of the normal A.C. signal to provide the additional required power to the light filaments.

THE DRAWINGS

In the accompanying drawings, which illustrate an embodiment of the invention constituting the best mode presently contemplated for carrying out the invention in actual practice;

FIG. 1 is a block diagram of a basic embodiment of the invention;

FIG. 2, a schematic diagram comparing the line A.C. voltage waveform with the waveform generated by the A.C. power phase control of the invention, and with the composite waveform generated by the invention which is fed to the standard fluorescent lamp ballast;

FIG. 3, an expanded block diagram of a basic embodiment of the invention as described in detail herein;

FIG. 4, a block diagram of the presently preferred embodiment of the invention;

FIG. 5, a circuit diagram of the preferred power supply of the invention;

FIG. 6, a circuit diagram of the preferred SCR Phase Control circuitry;

FIG. 7, a circuit diagram of the preferred 16 KHz Square Wave Generator;

FIG. 8, a circuit diagram of the preferred High Frequency Window Generator;

FIG. 9, a circuit diagram of the preferred Pulse Width Control and Sync. Switch;

FIG. 10, a circuit diagram of the preferred High Frequency Transformer Driver;

FIG. 11, a circuit diagram of the preferred High Frequency Driver and Current Sense circuitry;

FIG. 12, a circuit diagram of the preferred Control and Power circuitry;

FIG. 13, a circuit diagram of the preferred Current Trip circuitry;

FIG. 14, a circuit diagram of the preferred High Frequency Amplitude and Balance Test circuitry;

FIG. 15, a circuit diagram of the preferred Low Level Off circuitry;

FIG. 16, a circuit diagram of the preferred Power Monitor and Relay Driver circuitry;

FIG. 17, a circuit diagram of the preferred Soft Start circuitry; and

FIG. 18, a circuit diagram of the preferred Light Feedback Control circuitry.

DETAILED DESCRIPTION OF THE ILLUSTRATED EMBODIMENT

Figure 1:
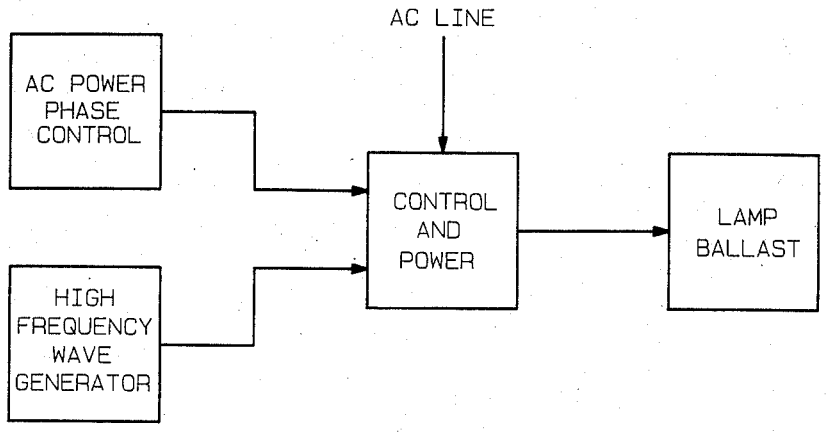

FIG. 1 shows a basic simplified block diagram for the circuitry of the invention. The circuitry is connected between the normal 120 volt A.C. or 240 volt A.C. power line and the fluorescent lamp ballast so that when the power is switched on, the circuitry is operational and controls the power supplied to the lamp ballast.

Figure 2:
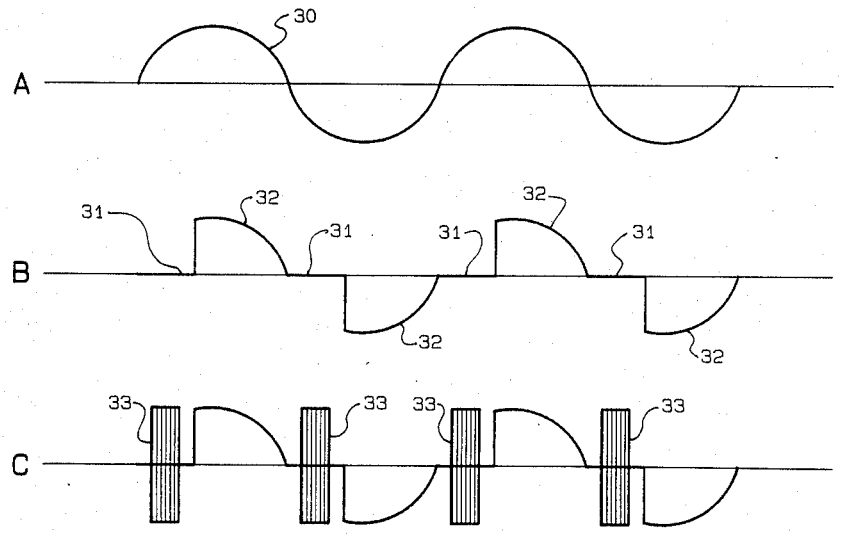

The main light level control of the invention is the A.C. power phase control. This circuitry controls the phase angle of the A.C. power supplied to the lamp ballast, i.e. the amount of time during each half cycle of the A.C. sign wave that line power is supplied to the ballast. Thus, as shown in FIG. 2, while the line A.C. voltage is shown as the sinusoidal wave 30 on axis A, the portion of that actually applied to the load is a waveform shown in axis B having an "off" time 31 where the value is zero and an "on" time 32 where the value of the waveform is the same as the line voltage. By varying the respective "on" and "off" times of the wave applied to the lamp ballast, the power applied to the ballast is controlled. The longer the "on" time, the closer the effective voltage applied to the ballast is to the line voltage and the closer to full voltage and full brightness of the lamps. The longer the "off" time, the lesser the effective voltage applied to the lamp ballast and to the lamp and the lower the brightness of the lamps. The A.C. power phase control determines the "on" and "off" times of the A.C. line power to the ballast.

This type of phase control is commonly used in brightness controls for incandescent lamps, but as explained in the Background of the Invention, is not used with fluorescent lamps. To make this type of phase control practical for use with fluorescent lamps over a wide dimming range, it is necessary to provide additional power to the filaments of the lamps. It has been found that by inserting a high frequency signal into the "off" times of the line voltage applied to the ballast, the filament is supplied with its required power while, at the same time, because of the air gap in the high voltage portion of the ballast which substantially blocks high frequency signals, the discharge portion of the lamp does not receive the high frequency power, and effective dimming over a wide range is achieved.

The high frequency generator produces the high frequency signal for application to the ballast during the A.C. line voltage "off" times. This high frequency signal does not have to completely fill the "off" time, but is effective if applied during a portion of the "off" time. Thus, a high frequency signal, such as a high frequency square wave shown schematically in FIG. 2, axis C, as 33 is inserted during the "off" time 31 of the line voltage applied to the ballast so that the composite waveform shown on axis C is actually applied to the ballast.

The control and power block combines the signals from the A.C. power phase control and the high frequency generator and produces the final output signal which is applied to the normal fluorescent lamp ballast shown as a block in FIG. 1. The ballast is a part of all standard fluorescent lamps and is not part of the current invention. Further, while a single ballast is shown, where many sets of lamps are controlled in a room with a single switch, those ballasts will all be connected to the circuitry in parallel with the ballast shown.

Figure 3:
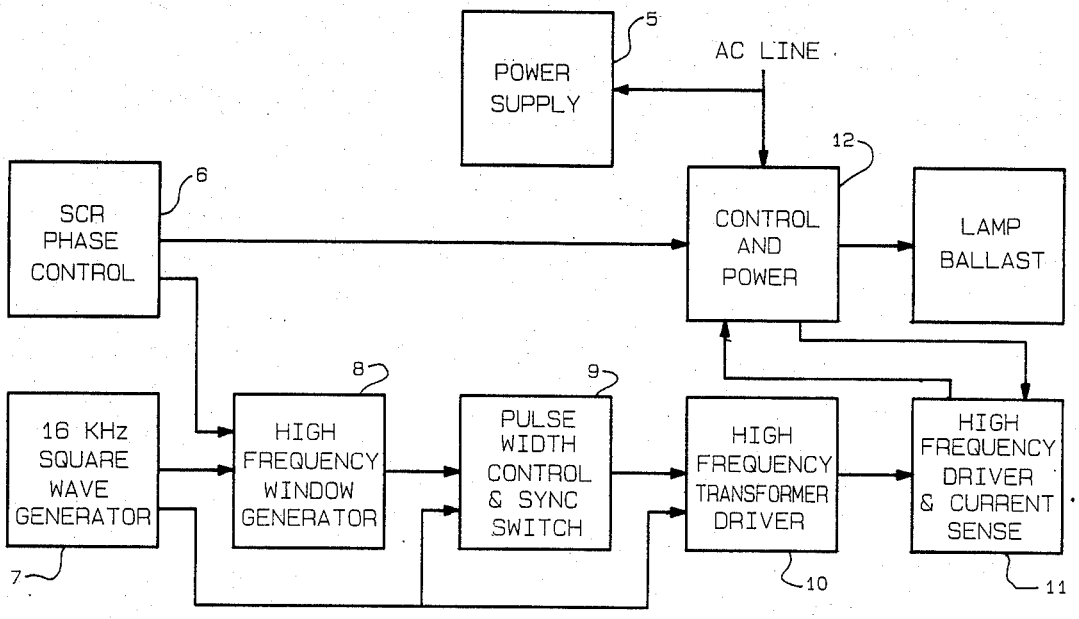

FIG. 3 shows a block diagram for the basic blocks as provided in the presently preferred embodiment of the invention. These are the blocks neseccary to produce the output signal to the lamp ballast. In addition to the basic blocks shown in FIG. 3, the presently preferred embodiment of the invention provides several safety features and some desireable operational features not necessary from a purely functional standpoint, but found desirable by the inventor. These features result from the additional blocks shown in FIG. 4, but not in FIG. 3.

Referring to FIG. 3, the SCR phase control circuitry generates signals to control the relative "on" and "off" times of the line A.C. voltage and supplies these signals to the control and power circuitry where the A.C. signal is actually formed by SCR's or a triac.

The high frequency signal, preferably a 16 KHz square wave, is initially generated by the 16 KHz square wave generator.

Since the high frequency signal is applied only during the "off" time of the A.C. line signal, that "off" time has to be determined and a signal generated indicating when to apply the high frequency signal. This is done by the high frequency window generator which receives an input signal from the SCR phase control and from the 16 kHz square wave generator and produces an output signal indicating when the square wave should be applied to the output, such signal generally includes a time delay to insure no overlap of the two signals.

Because a square wave having the same peak-to-peak voltage as the line A.C. wave is presently preferred as the high frequency signal, it is desireable to reduce the duty cycle of the square wave to about 50% to provide the same root-mean-square (RMS) voltage to the ballast as would be applied by an equivalent sinusoid. This duty cycle adjustment of the square wave is accomplished by the pulse width control and sync. switch which also synchronizes the signal so that a square wave does not start or end in the middle of a cycle.

The high frequency transformer driver receives the signal indicating when the high frequency square wave should be applied to the output from the pulse width control and sync switch and also receives the 16 KHz square wave signal from the square wave generator and produces an output 16 kHz square wave during the desired period. This signal is supplied to the high frequency driver and current sense circuitry which converts the signal to the actual voltage to be applied to the output. This signal is then combined with the phase controlled line voltage signal by the control and power circuitry to produce the composite waveform shown in FIG. 2 and applies that signal to the ballast. The current sense in the high frequency driver is merely a safety feature to protect against excessive current drawn by the load during the high frequency portion of the waveform, and senses and produces an output when excessive current is drawn.

Figure 4:
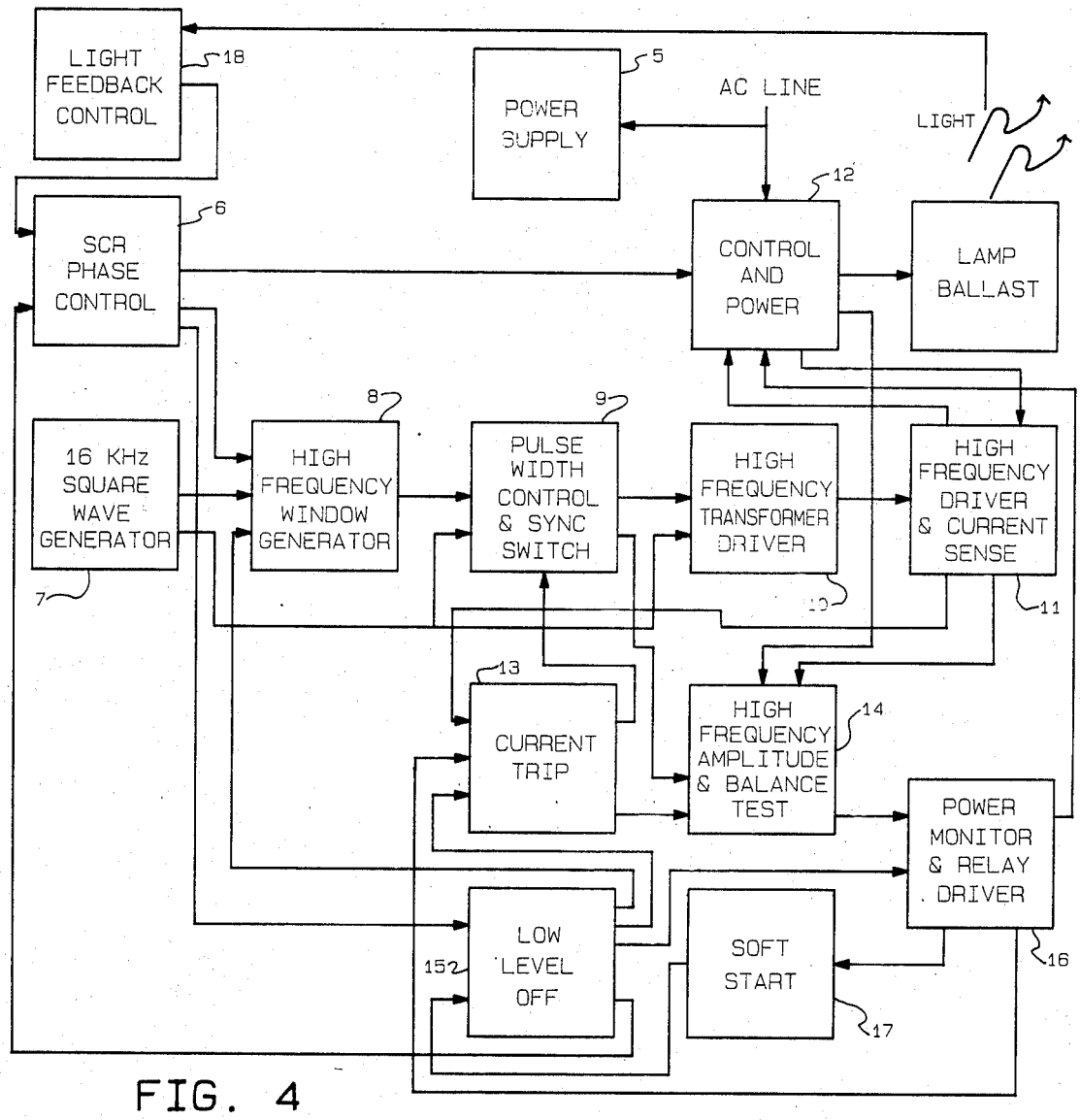

Referring to FIG. 4, current trip circuitry receives the signal from the high frequency drive and current sense circuitry indicating excessive current draw during the high frequency portion of the signal and sends an output signal to the pulse width control and sync switch circuitry which blocks generation of the high frequency signal, thereby, in effect, disconnecting the high frequency signal from the load ballast. The current trip circuitry also sends a signal to the high frequency amplitude and balance test circuitry, which results in disconnecting completely the circuitry of the invention from the load.

The high frequency amplitude and balance test circuitry operates to disconnect the power from the circuitry of the invention to the load ballast upon certain error conditions in the circuitry. This circuitry receives the output high frequency square wave from the high frequency driver and current sense circuitry and compares the value of the positive peak voltage with the negative peak voltage. If a substantial difference exists, it sends a signal to the power monitor and relay driver circuitry which disconnects the power to the load ballast, the test circuitry also compares the peak positive voltage of the square wave from the high frequency driver and current sense circuitry with the peak positive voltage of the line A.C sine wave from the control and power circuitry, and if substantially different, also signals the power monitor and relay driver to disconnect the power. The comparison is made during the time the high frequency is connected to the load and the signal from the high frequency window generator indicates when the comparison takes place. Also, in the event of a signal from the current trip circuitry indicating an over current in the high frequency signal, the high frequency amplitude and balance test circuit signals the power monitor and relay drive to disconnect the power.

The power monitor and relay driver controls a relay which connects the output power from the invention to the load ballast and disconnects the power when told to do so by the high frequency amplitude and balance test circuitry. It also monitors the A.C. line voltage level and if the voltage drops significantly below its normal value, also disconnects power from the circuitry to the load ballast. The control is preferably by means of a relay so that in the event of a fault in the circuitry which causes it to be disconnected from the load ballast, the load ballast is then connected directly to the A.C. line so the lamps remain lighted in the event of a circuit failure.

In operation of the circuitry, if the illumination level set for the lamps is too low, the lamps will flicker. The low level off circuitry compares the level set either manually or automatically into the SCR phase control circuitry with a preset level below which flicker is likely to occur and if the level set falls below the preset level, sends a signal to the current trip circuitry to cause it to block the generation of the high frequency signal and sends a signal to the SCR phase control circuitry to block transmission of any of the A.C. line power to the load. This then turns the lights out. In such circumstance, the circuitry of the invention should remain connected to the load so that the lights will remain out as long as the level is low and so that when the level is turned up, the lights come back on from their off condition. Thus, the low level off circuitry sends a signal to the power monitor and relay driver circuitry to block any error signal received by such circuitry that would otherwise cause disconnection of the circuitry and load during the time the lights are out due to a low level set.

It is also desireable to delay application of the high frequency signal to the load upon start up of the circuitry and during test and reset operations of the power monitor and relay driver circuitry. For this purpose, the soft start circuitry obtains a signal from the power monitor and relay driver indicating when such operations are taking place and sends a signal to the low level off circuirty to cause the high frequency signal to be initially blocked and start only after application of the controlled A.C. signal to the load has begun. This delayed application of the high frequency signal has no harmful effect on the lamps since it is the long term use of only the phase controlled A.C. without the superimposed high frequency signal for the filament that effects lamp life.

The light feedback circuitry senses the light actually present in the room to be illuminated using the circuitry of the invention and compares the sensed light level with a preset level. It then sends a control signal to the SCR phase control to maintain the room illumination at the desired set level.

The power supply provides power to the various circuits and circuit components and although connections to the various other blocks are not shown so as not to complicate the drawings, is connected to each of the other blocks as will be apparent from the detailed circuitry illustrated for each of the blocks.

The presently preferred specific circuitry for the blocks of the invention is shown in FIGS. 5 through 18. When operational amplifiers are referred to, they may be National Semiconductor type LM358 and when comparators are referred to they may be National Semiconductor type LM-339. In many instances, four of these will be packaged together so that various of the separately illustrated semiconductor components may be packaged together and will have common power supply connection. Because of this, in the illustrated circuitry, some components will not be shown as having positive or negative supply voltage inputs when obviously they need to be and are supplied with power.

Figure 5:
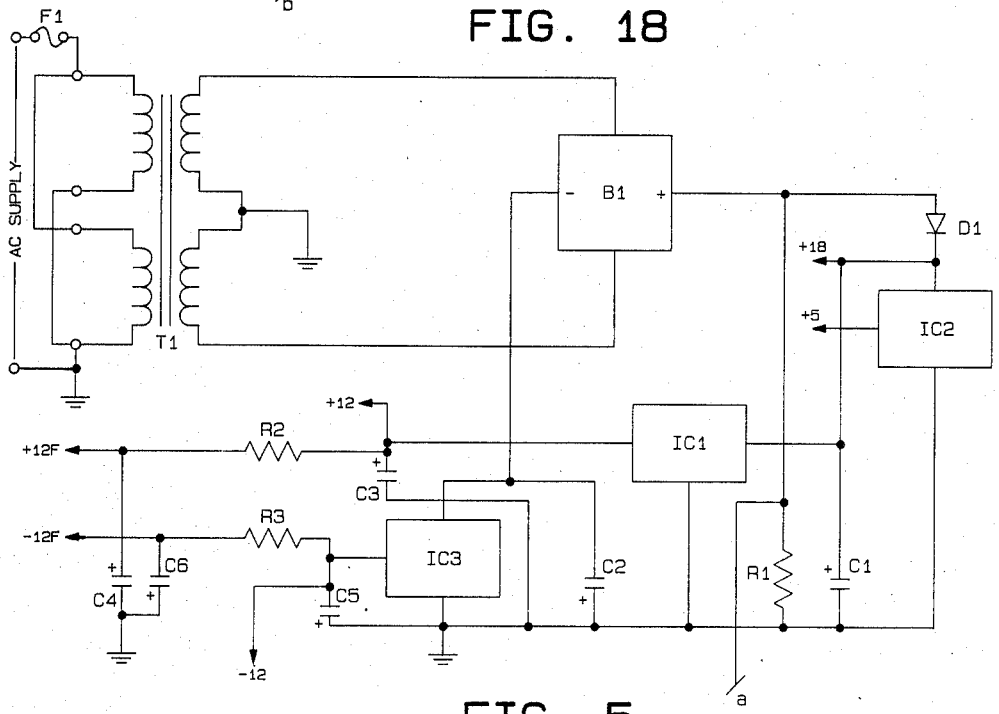

FIG. 5 shows power supply circuitry that can be used with the invention. The normal A.C. line voltage is supplied through fuse F1 to the primary windings of step down transformers T1. The secondary winding of transformer T1 has a center tap which is connected as the ground reference for the circuit. The secondary windings are connected to a full wave rectifying bridge B1, such as a Mallory type FW-50, with the positive output of B1 connected through diode D1 to filter capacitor C1. The negative output of B1 is connected to filter capacitor C2. The transformer preferably steps down the line voltage to about 24 volts so that with the center tap, the filtered voltage across capacitor C1 is about ~volts and the voltage across capacitor C2 is about −18 volts. Diode D1 isolates capacitor C1 so that the positive rectified output of B1 appears across resistor R1 and is fed to the SCR control circuit, FIG. 6, through connection a.

A 12 volt voltage regulator IC1 such as a National Semiconductor type 7812 is connected across capacitor C1 to produce a regulated +12 volt output as is also a five volt regulator IC2, such as a National Semiconductor type 7805, to produce a regulated +5 volt output. A 12 volt regulator IC3, such as a National Semiconductor type 7912, is connected across capacitor C2 to produce a regulated −12 volt output.

The +12 volt output of IC1 is connected across capacitor C3 and supplies +12 volts to the various circuits and components of the invention as needed. A further +12 volt supply is provided across capacitor C4 isolated from the output of IC1 by resistor R2. This provides an isolated and further filtered +12 volt supply for circuit components having low current requirements. This output is labeled +12F.

The −12 volt output of IC3 is connected across capacitor C5 and supplies −12 volts to the various circuits and components of the invention as needed. A further −12 volt supply is provided across capacitor C6 isolated from the output of IC3 by resistor R3. This provides an isolated and further filtered −12 volt supply for circuit components having low current requirements. This output is labeled −12F.

If different voltages are required by different embodiments of the circuitry, such different voltages may be provided for in various known manners.

Satisfactory component values for the power supply are R1-10 k ohms, R2 and R3-10 ohms, C1, C2 and C3-1000 micoforads, C4, C5, and C6-4.7 microforads, D1-1N5393.

Figure 6:
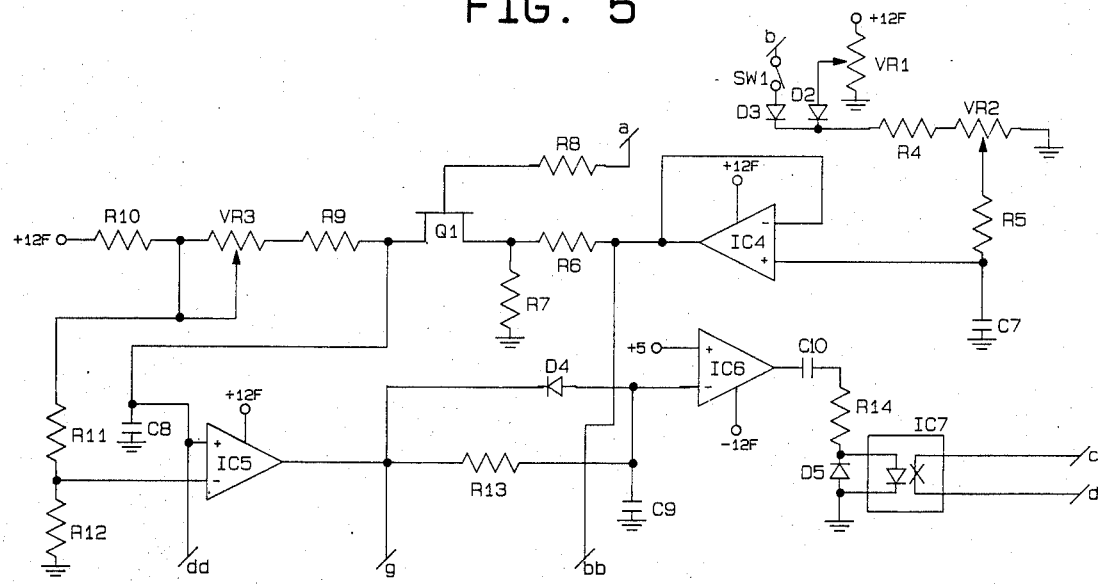

The SCR control circuitry is shown in FIG. 6. This circuit provides the control for the lamp brightness and can be set manually or automatically in the form of a voltage between 0 and +12 volts. Manual control is accomplished by setting variable resistor VR1 to provide a voltage between 0 and +12 volts through diode D2 across resistor R4 and variable resistor VR2. Resistor R4 limits the maximum voltage across variable resistor VR2 to 90% of the supply voltage across variable resistor VR1 to prevent inductive return voltages from the flourescent loads from creating an overvoltage condition in the region of near full cycle waveforms.

Figure 18:
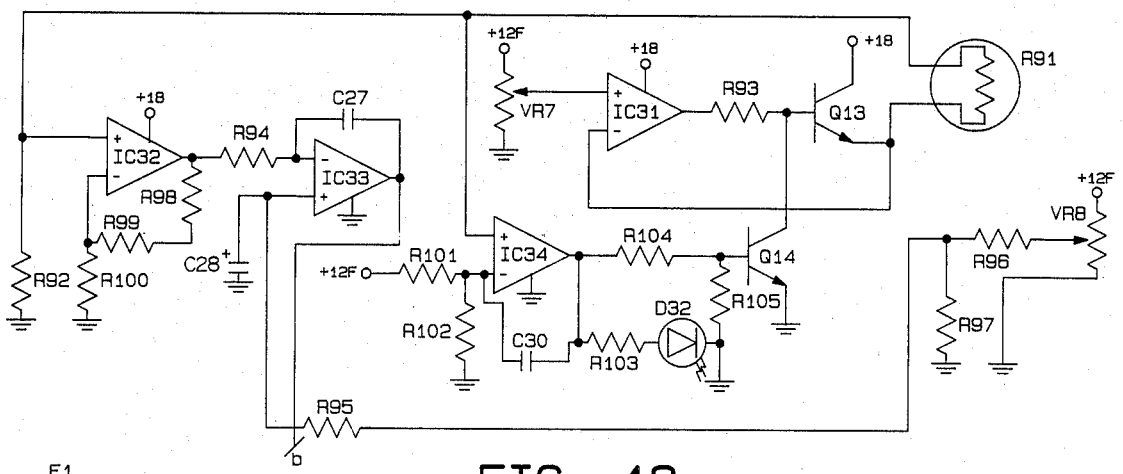

For automatic control, a voltage between 0 and +12 volts is applied at connection b, such as from a light feedback circuit which monitors room illumination and controls the lamp output to maintain a constant level of illumination. Such a circuit is shown in FIG. 18 and will be described later. The signal from the control circuit, be it the light feedback circuit or another type of illumination level control circuit, is connected through switch SW1 and diode D3 to resistor R4 and variable resistor VR2. Switch SW1 allows the automatic control to be switched in or out of the circuit and when connected in the circuit, diodes D2 and D3 allow the higher of the voltage from the automatic control or the manual control VR1 to actually control the illumination level.

Variable resistor VR2 provides a filtered voltage through resistor R5 and capacitor C7 to the noninverting input of operational amplifier IC4 which is connected as a voltage follower and also isolates variable resistor VR2 from the circuit load. The output voltage of operational amplifier IC4 is applied to a voltage divider made up of resistors R6 and R7. The junction between R6 and R7 provides a voltage lower but proportional to the voltage output from IC4. This voltage is connected to field effect transistor (FET) Q1 which may be a standard 2N5460. The gate of Q1 is connected through resistor R8 to the signal from the power supply which is the nonfiltered positive, full wave rectified voltage supplied by connection a of FIG. 5. Resistor R1 in the power supply circuitry of FIG. 5 insures a zero bias on transistor Q1 during the period of zero voltage (zero crossing of the line A.C.) from the positive terminal of B1. With FET Q1 connected as shown, it conducts (has zero bias on the gate) for a short period during each zero crossing of the A.C. line voltage applied to the power supply. During the off time of Q1, capacitor C8 is charged through resistor R9 and variable resistor VR3 toward a voltage obtained at the junction of resistors R10 and R11 in a voltage divider made up of resistors R10, R11, and R12. When Q1 conducts, it connects capacitor C8 across resistor R7 so that capacitor C8 discharges to the voltage at the junction of resistors R6 and R7. Such voltage is proportional to the voltage supplied by either the manually set variable resistor VR1 or an automatic control such as a light feedback circuit. The voltage on capacitor C8 and the voltage across resistor R12 are compared by operational amplifier IC5 connected as a voltage comparator. When the voltage on capacitor C8 exceeds the voltage across resistor R12, IC5 produces a positive output which is connected to the inverting input of operational amplifier IC6 through resistor R13 and capacitor C9 which effectively form a delay line for the output of IC5. When IC5 provides an input to IC6, IC6 provides a pulse signal through capacitor C10 and resistor R14 to optical isolator IC7 such as a Theta-J type OFM-1A. IC7 then provides gate current in the proper phase to silicon control rectifiers SCR1 and SCR2 in the control and power circuitry of FIG. 12, through connections indicated as c and d. The SCR's, in turn, connect the A.C. line to the flourescent lamp ballast. Once conducting, an SCR will stay on until the next zero crossing of the supply voltage delayed by the current lag due to the inductive nature of the ballast. Since the output of IC5 remains high from the time it goes high until the next zero crossing of the line voltage which causes discharge of capacitor C8, the output of IC6 will also remain high until that time. Therefore, the output of IC6 to isolator IC7 is passed through capacitor C10 to provide a pulse to isolator IC7 and prevent retriggering of the SCR's after the zero crossing of the supply voltage. Diode D4 provides rapid discharge of capacitor C9 upon IC5 going low to reset the circuit in preparation for the next cycle of operation, and diode D5 is provided as protection for IC7 from reverse voltages.

To summarize the operation of the SCR phase control circuitry, capacitor C8 is discharged to a preset and adjustable voltage at each zero crossing of the line voltage. Capacitor C8 then charges at a set rate independent of line voltage until it exceeds the voltage across resistor R12 at which time a positive output is produced by IC5. This output is delayed from the zero crossing of the line voltage by the time it takes capacitor C8 to charge to a voltage exceeding the voltage across resistor R12. This time delay is dependent upon the voltage to which capacitor C8 has been discharged at each zero crossing which is determined by the setting of the manual control VR1 or the automatic control. The positive output of IC5 produces a delayed positive output of IC6 which turns on the appropriate SCR to cause the line voltage to be supplied to the load ballast. As will be seen later, the delay between the output of IC5 and IC6 insures that the high frequency square wave is off before the SCR's begin to conduct the line voltage.

With operation as described, the SCR control circuit produces an output signal delayed from the zero crossing of the incoming A.C. line voltage, the amount of delay being adjustable either manually or automatically. The sooner the signal produced by the circuit after the zero crossing, the longer time the A.C. line power will be applied to the lamp ballast and the brighter the lamps.

Satisfactory component values for the circuitry of FIG. 6 are VR1-10k ohms, VR2-100k ohms, VR3-1, Mohms, R4-10k ohms, R5-330k ohms, R6-1.5k ohms, R7-330 ohms, R8-100k ohms, R9-680k ohms, R10-5.6k ohms, R11-3.9k ohms, R12-1k ohms, R13-10k ohms, R14-470 ohms, C7-0.1 microfarad, C8-D.022 microfarad, C9-0.1 microfarad, C10-4.7 micraforad, D2 and D3-1N5393, D4 and D5-1N914.

Figure 7:
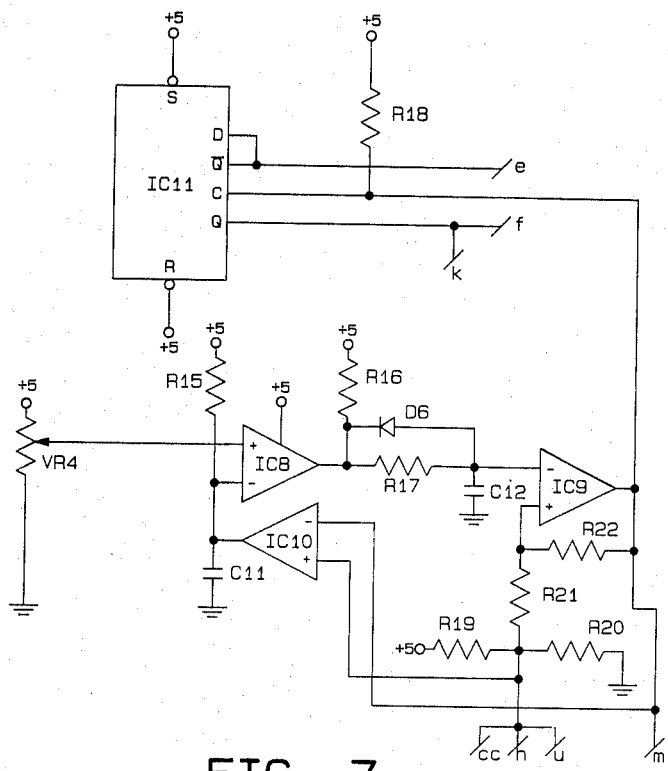

Specific circuitry for the 16 kHz square wave generator is shown in FIG. 7. This circuit includes an adjustable rate pulse generator which feeds pulses to a counter at twice the desired high frequency drive signal. The output of the counter produces the high frequency drive signal.

The frequency of the adjustable rate pulse generator is set by variable resistor VR4. The voltage on the wiper of variable resistor VR4 is applied to the noninverting input of high speed comparator IC8. The inverting input of IC8 is connected to capacitor C11 which is charged from the positive five volt supply through resistor R15. When the voltage on capacitor C11 is less than the voltage from the wiper of VR4, the output of IC8 is open and is thus driven high because of the positive supply voltage connected to the output through resistor R16. The output of IC8 is connected through resistor R17 to the inverting input of high speed comparator IC9. With the output of IC8 high, the charge on capacitor C12 is high and the output of IC9 is low, i.e. grounded. As the voltage on capacitor C11 connected to the inverting input of IC8 increases and exceeds the voltage from variable resistor VR4, the output of IC8 becomes low which causes capacitor C12 to rapidly discharge through diode D6 and the output of IC9 to become high. As the output of IC9 becomes high, the high signal, obtained from the positive supply through resistor R18, is fed to the inverting input of high speed comparator IC10 which causes the output of IC10 to become low which discharges capacitor C11 and causes the output of IC8 to again become high. The output of IC9 will become low after a fixed delay provided by resistors R16, and R17 and capacitor C12 since diode D6 is reverse biased. The delay is necessary to slow the operation of the high speed comparators and provide a pulse of reasonable width at the output of IC9. As the charge on capacitor C12 builds up and reaches a voltage higher than the voltage supplied through biasing resistors R19–R22 to the noninverting input of IC9, the output of IC9 becomes low. This low signal on the inverting input of IC10 causes the output of IC10 to open, allowing capacitor C11 to start charging to initiate another cycle of operation. The output of IC9 which is a series of pulses adjusted through variable resistor VR4 to be twice the desired square wave frequency, i.e., where the desired square wave frequency is 16 KHz, the pulse rate is 32 KHz, is connected as an input signal to counter IC11. The counter may be a National Semiconductor type 74LS74A. The output signals from counter IC11 provide the 16 KHz square wave and are supplied to the high frequency transformer driver circuitry of FIG. 10 through connections e and f.

The biasing resistors R19 and R20 are equal in value and form a voltage divider to provide a bias voltage of one half the positive five volt supply, i.e. 2.5 volts, not only to the further divider of resistors R21 and R22, but to various other circuits as well through connections, h,u, and cc as will be described.

Satisfactory component values for the circuitry of FIG. 7 are VR4-100k ohms, R15-100k ohms, R16-1k ohms, R17-10k ohms, R18, R19, and R20-1k ohms, R21-10k ohms, R22-100k ohms, C11-0.001 micrafarad, C12-100 picofarads, D6-1N914.

Figure 8:
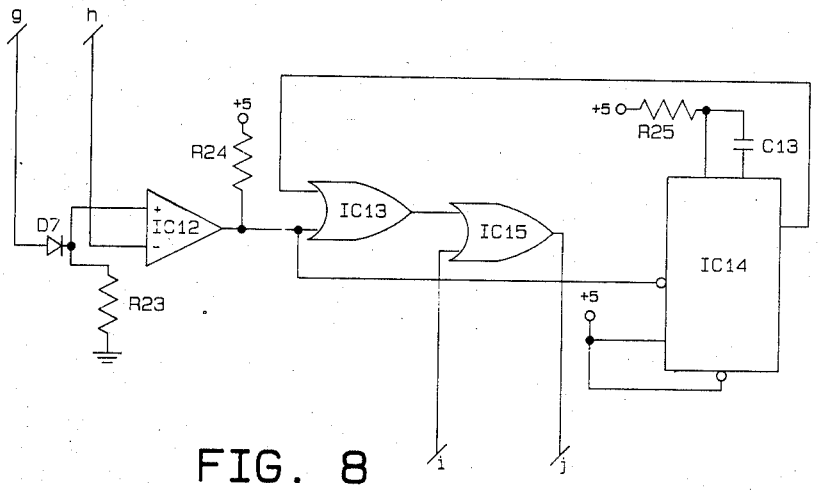

Since the 16 KHz square wave circuitry generates a continuous 16 KHz square wave and since the only time the 16 KHz square wave is provided to the fluorescent ballast is during a portion of the "off" time of the normal A.C. line voltage, the high frequency window generator circuitry shown in FIG. 8 is provided to determine the windor or time during which the 16 KHz signal should be applied to the load.

Referring back to the SCR phase control circuitry of FIG. 6, the output of IC5 goes high after a set delay from the line voltage zero crossing and such output, delayed by resistor R13 and capacitor C9, causes an output of IC6 to drive the SCR's to turn on the line A.C. to the lamp ballast. The same output from IC5 is provided through connection g to the high frequency window generating circuitry of FIG. 8.

The voltage signal enters the circuitry of FIG. 8 through terminal g and passes through isolation diode D7 and appears across resistor R23 at the noninverting input to high speed comparator IC12. The inverting input to IC12 is connected through connection h to the 2.5 volt bias signal produced by resistors R19 and R20 of the square wave generator circuitry of FIG. 7. This is done for convenience only as a separate additional bias divider could be provided in FIG. 8 or in the other places where the 2.5 volts from R19 and R20 is used. This bias signal on the inverting input of IC12 is below the voltage of the positive output of IC5 so that the positive output of IC5 on the noninverting input of IC12 causes the output of IC12 to open and go high by reason of the positive supply connected through resistor R24. Since the output of IC5 is high from the time it goes high until the next zero crossing of the line voltage, the output of IC12 will also remain high during that time and thus remain high through the entire time the A.C. line voltage is applied to the load ballast. At the zero crossing of the line A.C., at the time the SCR's stop conducting the line A.C. to the load, the output of IC5 and the output of IC12 go low. The output of IC12 is connected as an input of OR gate IC13 and as an input to one-shot IC14. The OR gate may be a National Semiconductor type 74LS32 and the one-shot a National Semiconductor type 74LS123.

With a high output on IC12, OR gate IC13 produces a high output. The high output of IC12 does not produce an output of one-shot IC14, but, when the output of IC12 goes from high to low, it causes one-shot IC14 to produce a high output that is fed to the other input of OR gate IC 13. The duration of the high output pulse of one-shot IC 14 is determined by resistor R15 and capacitor C13, and keeps the output of IC13 high for the duration of the positive output of the one-shot. The signal from the one-shot IC14 delays the application of the high frequency signal to the load ballast after the line A.C. zero crossing until after the fixed delay provided by the width of the one-shot output pulse. Thus, the output of IC13 goes high upon a high output of IC12 which starts prior to application of the A.C. line voltage, the amount of time prior being determined by the time the output of IC6 in the circuitry of FIG. 6 is delayed from output of IC5, and remains high until after application of the line A.C., the amount of time after being determined by the length of the positive output pulse of one-shot IC14.

The output of OR gate IC13 is connected as an input to a similar OR gate IC15 so that when the output of IC13 is high, the output of IC 15 is also high. The second input of OR gate IC15 is controlled and held low during normal operation by the low level off circuit of FIG. 15 which will be described later. The connection to the low level off circuitry is through connection i. The window generating circuit is set up so that as long as there is a high output signal from OR gate IC15, the high frequency signal will not be applied to the lamp ballast.

Satisfactory component values for the circuitry of FIG. 8 are R23-10k ohms, R24-1k ohms, R25-20k ohms, C13-0.1 microfarads, D7-1N914.

Figure 9:
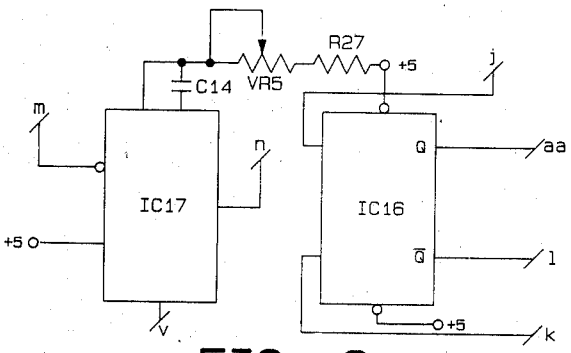

The output of IC15 is connected through connection j to flip-flop IC16, such as National Semiconductor type 74LS74A, in the pulse width control and sync. switch circuitry shown in FIG. 9. The flip-flop is clocked by one of the 32 KHz output signals from counter IC11 of FIG. 7 through connection k to the clock input of IC16. A high signal from IC15 through connection j to the data input of IC16 will cause the $\overline{Q}$ output of the flip-flop connected through connection 1 to the high frequency transformer driver circuitry shown in FIG. 10, to go low during the leading edge of the clock pulse. The low output will remain until the signal from IC15 on the data input of IC16 goes low, at which time, the $\overline{Q}$ output of IC16 will go high, but not until the leading edge of the next clock pulse. Thus, IC16 produces a high signal during the time that the high frequency signal can be applied to the load ballast and such signal is synchronized so that the high frequency square wave signal starts at the start of a square wave cycle and ends at the end of a square wave cycle. Such synchronization with the start and end of a full cycle of the high frequency pulse is desirable to eliminate short bursts of high voltage to the lamp ballast and lamp which might cause flicker in the lamps by turning on the SCR's with a fast rising voltage.

The pulse width control and sync. switch circuitry controls the duration of application of the high frequency signal to the lamp ballast. The 32 kHz pulses from IC9 of the 16 kHz square wave generating circuitry of FIG. 7, in addition to being applied as the input signal to counter IC11 of that circuitry, are also provided through connection m to the input of one-shot IC17. The output of IC17 is connected through connection n to the high frequency transformer driver circuitry, FIG. 10. The width of the output signals from IC17 is adjusted by resistor R27, variable resistor VR5, and capacitor C14, and is preferable adjusted to be one quarter of the high frequency period, thus providing a signal to the high frequency transformer driver circuitry which reduces output drive current to a fifty percent duty cycle. This duty cycle, when applied to each cycle of a positive and negative going square wave, provides a root-mean-square (RMS) value equal to an equivalent sinusoidal source with peak values equal to the peak values of the square wave.

In the circuitry of FIG. 9, R27 may be 31k ohms, VR5 may be 10k ohms, and C14 may be 0.001 microfarad.

Figure 10:
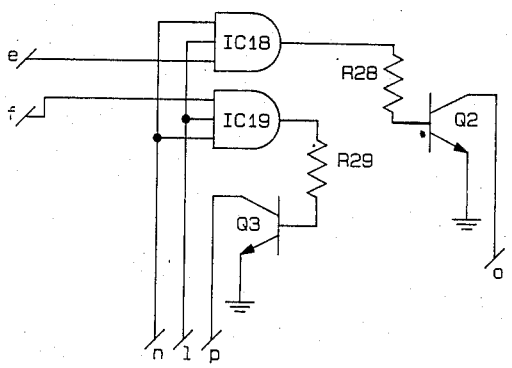
Figure 11:
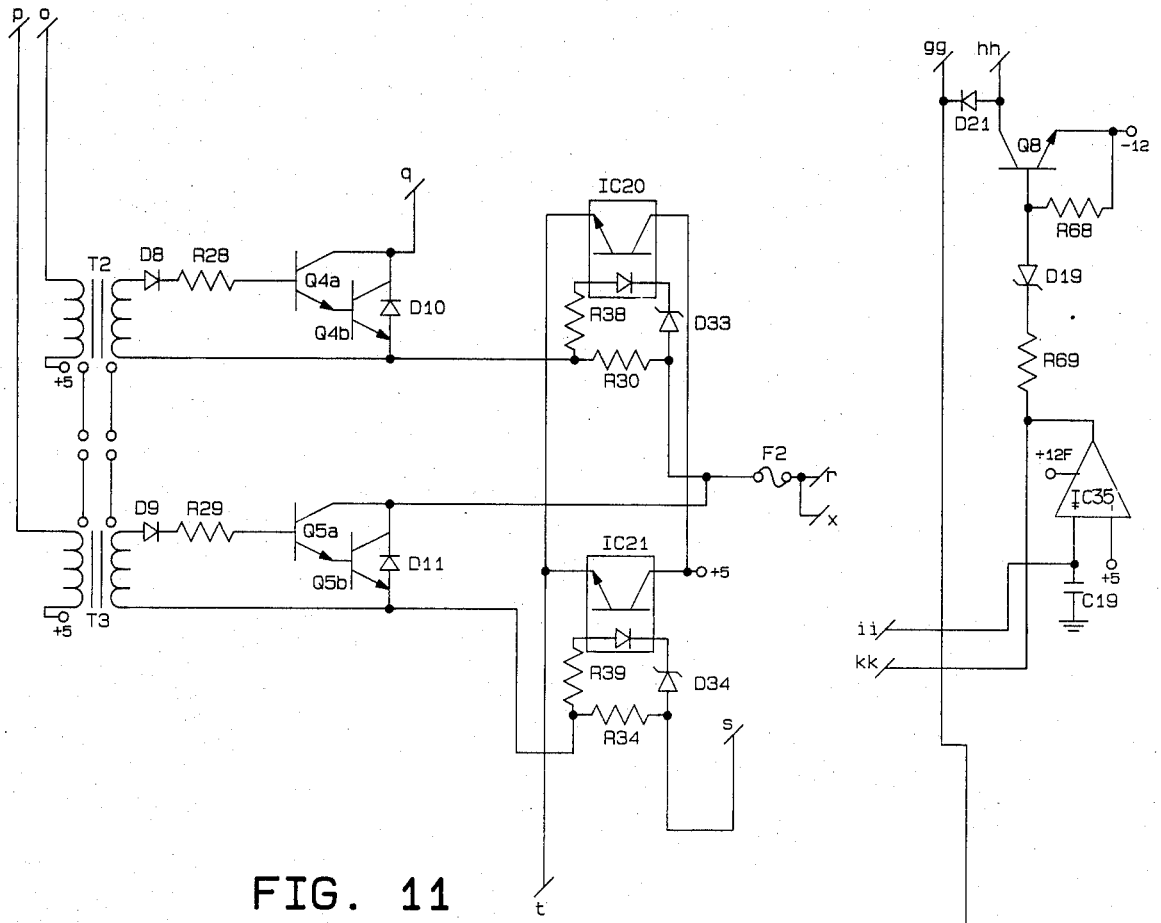

The high frequency transformer drive circuitry shown in FIG. 10 actually provides the drive signal to the high frequency driver and current sense circuitry, FIG. 11. The output signals from counter IC11 in the high frequency square wave generating circuitry of FIG. 7 are connected through connections e and f as inputs to respective AND gates IC18 and IC19, such as National Semiconductor type 74LS11. The signals from counter IC11 are pulse trains of 32 KHz with a pulse starting at each zero crosing of the A.C. line voltage. The pulses for positive conduction occur at connection e and the pulses for negative conduction at connection f, and are out of phase with one another.

The other inputs to the AND gates are the signal from the output of flip-flop IC16 of FIG. 9 through connection 1 and the output of one-shot IC17 of FIG. 9 through connection n.

In order to produce an output at either of AND gates IC18 or IC19 all inputs must be high. The signal from flip-flop IC16 is low during the application of the A.C. line voltage to the lamp ballast and during times when other protection circuits indicate the high frequency signal should not be applied to the load. At all other times the signal is high. The signal from one shot IC17 goes high at the start of each half cycle of the high frequency square wave and stays high for the time set by the one-shot IC17, preferably, as explained above, for one quarter of the high frequency period.

As a result of the signals described, all inputs to AND gate IC18 will go high during one quarter of the high frequency period and all inputs to AND gate IC19 will go high during one quarter of the high frequency period beginning one half period after the inputs to IC18 go high.

The output of AND gate IC18 is connected through resistor R28 to the base of transistor Q2. The collector of transistor Q2 is connected through connection o to the primary winding of high frequency drive transformer T2 in high frequency driver and current sense circuitry of FIG. 11, and the emitter of transistor Q2 is connected to ground. Thus, when a positive signal from IC 18 appears on the base of Q2, Q2 conducts, allowing current to flow from the positive supply through the primary winding of transformer T2, and through transistor Q2 to ground.

The output of AND gate IC19 is connected through resistor R29 to the base of transistor Q3. The collector of transistor Q3 is connected through connection p to the primary winding of high frequency drive transformer T3 in FIG. 11, and the emitter of transistor Q3 is connected to ground. When a positive signal from IC19 appears on the base of Q3, Q3 conduct, allowing current to flow from the positive supply through the primary winding of transformer T3, and through transistor Q3 to ground. Transistors Q3 and Q4 may be 2N3569's and resistors R28 and R29 may each be 1k ohms.

The result of the circuitry of FIG. 10 is that the respective AND gates IC18 and IC19 provide 25% duty cycle signals to the bases of transistor Q2 and Q3, respectively, at alternate half cycles of the high frequency square wave so that Q2 conducts for 50% of the positive half cycle and Q3 conducts for 50% of the negative half cycle. Together, these transistors control the high frequency square wave to the load.

The high frequency driver and current sense circuitry is shown in FIG. 11. The square wave signals from transistors Q2 and Q3 are connected through connections o and p, respectively, to the primary winding of transformers T2 and T3 respectively. These signals applied to the primary windings are transmitted through the transformer to the secondaries. The signal from the secondary winding of transformer T2 is applied to a Darlington connection of power transistors Q4*a* and Q4*b* through isolating diode D8 and current limiting resistor R28. The signal from the secondary winding of transformer T3 is applied to a Darlington connection of power transistors Q5*a* and Q5*b* through isolating diode D9 and current limiting resistor R29. Didoes D8 and D9 prevent damage to the transformers in case of power transistor failure and the resistors R28 and R29 limit the base drive to transistors Q4*a* and Q5*a*.

Figure 12:
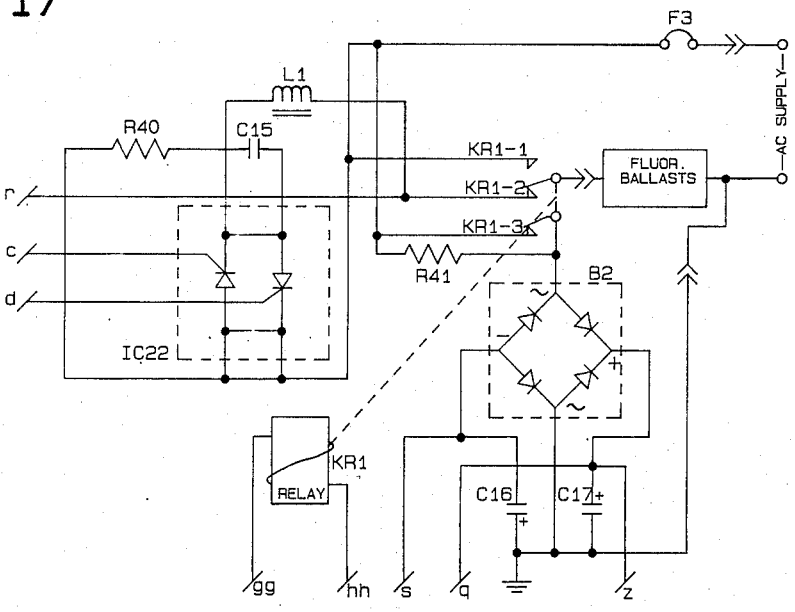

Darlington power transistors Q4*a* and Q4*b* control the application of positive voltage to the load with the positive supply voltage from the control and power circuitry of FIG. 12 connected to the respective collectors through connection q and with the emitter of Q4*b* connected through current sensing resistor R30 to the collector of Darlington power transistors Q5*a* and Q5*b* and to the fluorescent ballast via the control and power circuitry of FIG. 12 through fuse F2 and connection r. Darlington power transistors Q5*a* and Q5*b* control the application of negative voltage to the load with the negative supply voltage from the control and power circuitry of FIG. 12 connected through connection s and current sensing resistor R34 and with the collector connected to the fluorescent ballast via the control and power circuitry of FIG. 12 through fuse F2 and connection r. Diode D10 is connected between the collector and emitter of transistor Q4*b* and diode D11 is similaly connected with respect to Q5 to prevent inductive voltage surges from exceeding the limits of the positive or negative supply voltage.

Figure 13:
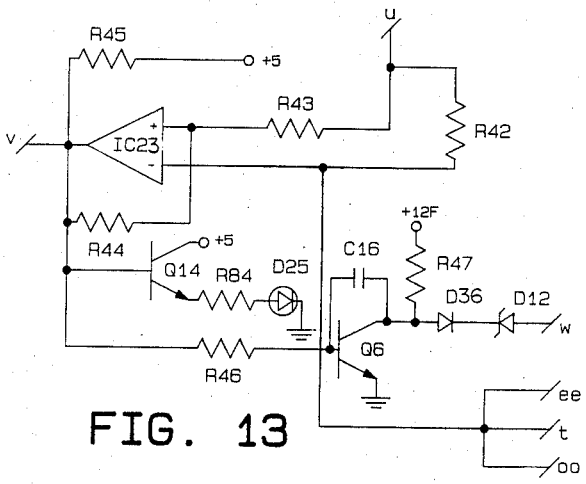

A series connection of resistor R38, opto-isolator IC20, and zener diode D33 is connected in parallel with current sensing resistor R30 so that the opto-isolator will turn on and provide a positive voltage through connection t to the current trip circuitry of FIG. 13 is the current from transistor Q4*b* exceeds about seven amps. Similarly, a series connection of resistor R39, opto-isolator IC21, and zener diode D34 is connected in parallel with current sensing resistor R34 so that the opto-isolator will turn on and provide a positive voltage, again through connection t, to the current trip circuitry of FIG. 13 if the current from transistor Q5*b* exceeds about seven amps. This provides a safety feature to shut off the high frequency power to the lamp ballast in the event of excessive current draw.

The opto insolators IC20 and IC21 may be Texas Instruments type T1L111. Other satisfactory circuitry components are R28 and R29-100 ohms, R30 and R34-0.25 ohm, R38 and R39-10 ohms, D8 and D9-2N4005, D10 and D11-1N914, D33 and D34-1N4686.

The control and power circuitry is shown in FIG. 12, and is the circuit that actually applies the power to the lamp ballast which, in turn, supplies the power to the filament portion of the fluorescent lamps and to the discharge portion of the lamps. The ballast is shown in FIG. 12 to illustrate how it is actually connected to the circuitry of the invention, but is not itself part of the circuitry of the invention.

The A.C. line voltage is connected to the ballast through a circuit breaker F3, the two silicon control rectifiers (SCR's) packaged together in SCR package IC22 which may be a silicon power cube type 8232, choke L1, and normally open relay contacts KR1-2. The SCR's are controlled by signals from the SCR phase control circuitry of FIG. 6 through connections c and d as described above. The signals from the circuitry of FIG. 6 turn on the SCR's at a variable time period after the start of the A.C. half cycle to thereby control the effective AC power applied to the ballast and lamps. Choke L1 limits the voltage rise time to the SCR's since the SCR's will turn on with application of a fast rise line voltage. Resistor R40 and capacitor C15 form a "snubber" circuit to reduce the rate of change of voltage acros the SCR's to prevent their false conducting.

The high frequency signal from the high frequency driver and current sense circuit of FIG. 11 enters the control and power circuitry through connection r and is connected to the ballast also through relay contact KR1-2.

Relay KR1 is provided as a safety feature and during operation of the circuitry will be in an energized condition as shown, thereby closing relay contacts KR1-2 and KR1-3 and opening relay contact KR1-1. In this condition, the A.C. line voltage as controlled by the SCR's and the high frequency signal as supplied by the high frequency and current sense circuitry is supplied to the lamp ballast through relay contact KR1-2. Also, the line A.C. voltage is supplied directly to full wave rectifying bridge B1 such as a Motorola type MDA2506 which provides half wave rectification to charge capacitors C16 and C17 to the peak value of the line voltage through the upper diodes in the bridge. The bridge also prevents C16 from receiving a positive voltage and C17 from receiving a negative voltage which condition would cause forward biasing of the lower bridge diodes toward neutral. The positive voltage across C17 is connected through connection q to the high frequency driver and current sense circuitry where it supplies the positive voltage for the high frequency square wave and the negative voltage across capacitor C16 is connected through connection s to the high frequency driver and current sense circuitry where it supplies the negative voltage for the high frequency square wave. The energization of relay KR1 is controlled by the power monitor and relay driver circuitry of FIG. 13. If a fault is detected in the system, the circuitry of FIG. 13 causes the relay to become deenergized thereby opening relay contact KR1-2 and KR1-3 and closing relay contact KR1-1 which connects normal line A.C. to the lamp ballast. Thus, in the event of a failure of the circuitry of the invention, the line A.C. is connected directly to the lamp ballasts so that the lamps are illuminated rather than going off.

When the system is intitially turned on, relay KR1 is in deenergized condition and line A.C. power is supplied through normally closed relay contact KR1-1 to the lamp ballast and through resistor R41 to bridge B1. This slows the charging of capacitors C16 and C17 to prevent line current surges as the power comes on. Relay KR1 becomes energized through the power monitor and relay driver circuitry when capacitor C16 becomes about 87% charged.

Satistactory component values for the circuitry of FIG. 12 are R40-500 ohms, R41-1k ohms, C15-0.1 microfarad, C16 and C17-1300 microfarad, L1-1 millihenry.

The circuitry described so far comprises the circuitry of the block diagram of FIG. 3 and produces the desired adjustable output waveform shown on axis C of FIG. 2. The relay KR1 could be left out of the circuitry and relay contacts KR1-2 and KR2-3 which are closed when the circuitry is operating replaced with direct wire connections, or relay KR1 could be energized by a manually operated switch so that the circuitry could be switched in and out of the line to the ballast when desired.

The remaining circuitry as shown in the block diagram of FIG. 4 and in detail in FIGS. 13–17 provides various safety features and various desireable options to the invention.

In various instances, it will be desireable to disconnect the power from the invention to the lamp ballast. In some instances the high frequency wave only is disconnected or is disconnected before the controlled A.C. line voltage is disconnected and in others, all power from the circuitry is disconnected through opening of relay contact KR1-2 in the control and power circuitry of FIG. 12.

As described for the high frequency driver and circuit sense circuitry of FIG. 11, the current drawn by the square wave applied to the load is monitored and if either the positive or negative current drawn rises above a predetermined maximum safe level, here selected to be about seven amps, a positive signal is generated by opto-isolator IC20 or IC21. This signal is fed through connection t to the inverting input of high speed comparator IC23 in the current trip circuitry shown in FIG. 13. The inverting input of comparator IC23 is normally biased at about one half the positive five volt supply by reason of connection through resistor R42 and connection u to the bias network of R19 and R20 of the square wave generator circuitry of FIG. 7. The noninverting input of IC23 is similarly connected through resistor R43 and connection u to the same bias network. Comparator IC23 has a positive feedback resistor R44 which causes a flip-flop action for comparator IC23. Thus, during start up or reset operation, the output of IC23 is open and drawn high by the positive supply connected through resistor R45. This provides a positive bias through feedback resistor R44 on the noninverting input of IC23 as compared to the inverting input to hold the output of IC23 high.

If an over current signal from the circuitry of FIG. 11 appears on the inverting input of IC23, the inverting input becomes positive with respect to the noninverting input and the output of IC23 goes low, thereby pulling the noninverting input of IC23 low through resistor R44 to insure that the output of IC23 remains low until reset. The output of IC23 is fed through connection v to the clear input of one shot IC17 of the pulse width control and sync. switch circuitry of FIG. 9. This causes the output of one shot IC17 to go low and remain low as long as the low output remains from IC23. As explained above, a low output of IC17 through AND gates IC18 and IC19 in the high frequency transformer driver circuitry of FIG. 10 blocks the generation of the high frequency signal for application to the load. Thus, upon sensing an overcurrent in the high frequency signal, the high frequency signal is turned off very rapidly.

The output of IC23 is also connected through current limiting resistor R46 to the base of transistor Q6. With the output of IC21 high, as is normally the case, transistor Q6 is on and the positive supply indicated is connected across resistor R47 to ground through transistor Q6. When the output of IC21 goes low, transistor Q6 is turned off and capacitor C16 begins to charge. The voltage across capacitor C16 is fed through diode D36, zener diode D12, and connection w to the amplitude test circuit of FIG. 14. This, as will be seen from the description of the circuitry of FIG. 14, will ultimately cause the release of relay KR1 and the disconnection of the power from the circuitry of the invention to the load ballast.

The delay between the blocking or disconnection of the AC phase control signal as will be described later and the high frequency signal and the deactivating of the relay KR1 caused by the time required to charge capacitor C16 is provided to protect the SCR's and allow the relay to trip the circuit breaker in the case of overcurrent in that portion of the applied power.

Satisfactory component values for the circuitry of FIG. 13 are R42 and R43-10k ohms, R44-100k ohms, R45-1k ohms, R46-10K ohms, R47-20k ohms, C16-47 microfarads, Q6-2N3569, D12-1N4686, and D36-1N914.

Figure 14:
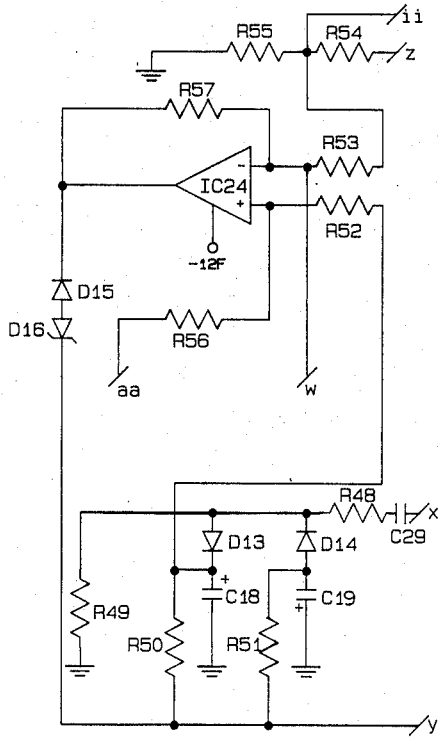

The preferred circuitry of the invention as described to produce a high frequency square wave having the same peak-to-peak value as the line A.C. voltage. If for some reason the peak-to-peak voltage of the high frequency signal drops substantially below the peak-to-peak value of the line voltage, a fault in the circuitry is indicated. Further, if the positive and negative peaks of the high frequency signal are not substantially equal, a fault is also indicated. The high frequency amplitude and balance test circuitry is shown in FIG. 14. The high frequency square wave from the high frequency driver and current sense circuit of FIG. 11 is fed through connection x and capacitor C29 to the voltage divider made up of resistors R48 and R49. Capacitor C18 charges through diode D13 to the positive voltage appearing across resistor R49 and capacitor C19 charges through diode D14 to the negative voltage appearing across resistor R49. Because of the voltage divider formed by resistors R48 and R49, the voltages across resistor R49 are proportional to but less than the positive and negative peak values of the high frequency square waves. It is preferred that resistors R48 and R49 be such that about plus and minus seven volts appear across R49 and charge capacitors C18 and C19 respectively. Capacitor C29 insures that only the high frequency signal is passed to resistor R49 and charges capacitor C18 and C19.

Resistors R50 and R51 are connected between capacitors C18 and C19 and if C18 and C19 have about equal but opposite charges as they will have if the positive and negative peaks of the square wave applied to the load ballast are about equal, the voltage at the point between R50 and R51 will be about zero volts. This voltage is supplied to the power monitor and relay driver circuitry of FIG. 16 through connection y. If the balance in the peak-to-peak value of the square wave changes, either a positive voltage or a negative voltage will appear depending upon the direction of the imbalance, and when that voltage reaches a certain preset level, will signal an alarm condition to the power monitor and relay driver. This will usually result in deenergization of the relay.

The positive voltage across capacitor C18 is connected through current limiting resistor R52 to the noninverting input of operational amplifier IC24 which is connected as a difference amplifier. The inverting input of IC24 is connected through resistor R53 to the junction of resistors R54 and R55 which forms a voltage divider for the positive rectified line voltage which appears across capacitor C17 of the control and power circuitry of FIG. 12, the connection being through connection z. The voltage across resistor R55 is set to be about the same as that across resistor R49 and capacitor C18 when the positive rectified line voltage is the same as the positive peak voltage of the square wave. Thus, IC24 is connected to amplify the difference between these two signals, which ordinarily should be very small. In order for IC24 to operate properly to measure the differences, resistor R56 connected to the noninverting input of IC24 should be grounded. If not grounded, and if high, the output of IC24 will be high and that high output will be blocked by diode D15. When grounded, IC24 works as a difference amplifier and if the input signal levels are the same, as they should be, the output of IC24 will be close to zero. If the square wave peak voltage drops significantly below the line voltage peak value on the inverting input, the output of IC24 becomes significantly negative, and when more negative then the breakdown voltage of zener diode D16, transmits a negative signal to the power monitor and relay driver circuitry of FIG. 16 through connection y. Because resistor R56 has to be grounded for the difference to be measured, the difference is measured only during the interval when high frequency is being applied to the load ballast. Resistor R56 is connected through connection aa to the Q output of IC16 in the pulse width control and sync switch circuitry of FIG. 9 which gives a high output during the time the portion of the line A.C. is being applied to the load and a low or grounded output during the time when the high frequency signal is being applied to the load. During this latter time, the low output of IC16 provides the zero reference through resistor R56 necessary for operation of IC24. Zener diode D16 allows some variation in the compared voltages before the difference output is great enough to create an error or alarm condition. Resistor R57 is a feedback resistor providing negative feedback to the amplifier.

Satisfactory component values for the circuitry of FIG. 14 are R48-200k ohms, R49-20k ohms, R50-100k ohms, R51-68k ohms, R52 and R53-100k ohms, R54-200k ohms, R55-10k ohms, R56 and R57-100k ohms, C18 and C19-1 microfarad, D13, D14, and D15-1N914, D16-1N4686.

The dimming circuitry works well over a wide dimming range, but at the very low end, will cause flicker of the lights before they go completely off. Therefore, it is desireable to shut off the regulated A.C. and the high frequency signal to the lamps when the A.C. voltage to the lamps reaches that low level where flicker would otherwise occur. This is done by the low level off circuitry shown in FIG. 15.

As indicated in the description of the SCR phase control circuitry of FIG. 6, the output of IC4 is a voltage proportional to the set voltage that controls the light illumination level. As indicated, this is set either manually by variable resistor VR1 or automatically by a voltage signal entering the circuitry of FIG. 6 at connection b.

Figure 15:
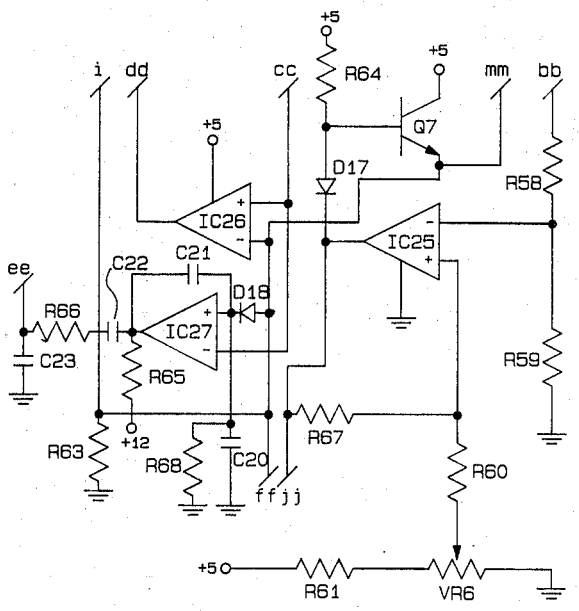

The output of IC4 is fed through connection bb to a voltage divider made up of resistors R58 and R59 in FIG. 15. The voltage at the junction of R58 and R59 is proportional to the output of IC4 and is fed to the inverting input of comparator IC25. The noninverting input of IC25 is connected through resistor R60 to variable resistor VR6 which is connected to the positive supply indicated through resistor R61. IC25 thus compares the voltage at the junction of R58 and R59, which is proportional to the set light illumination level, with a reference voltage set by VR6 which represents the minimum light level to prevent flicker of the lights.

With normal operation, the voltage on the inverting input of comparator IC25 will be higher than that from VR6 on the noninverting input so the output of IC25 will be low. This low or grounded output will keep the voltage on the base of transistor Q7, connected to the output of IC25 through diode D17 low with respect to the emitter and keep the transistor nonconductive. The emitter is connected to ground through resistor R63. This keeps the inverting input of comparator I26 low compared to the noninverting input which is connected through connection cc to the voltage divider made up of resistors R19 and R20 in the bias network of the square wave generator circuitry of FIG. 7. This provides a positive bias of about one half of the positive five volt supply on the noninverting input of IC26 and causes an open output of comparator IC26. This output is connected through connection dd to capacitor C8 and the noninverting input of IC5 in the SCR phase control circuitry of FIG. 6, and, because it is merely an open circuit, allows that circuitry to operate as previously described. If the voltage on the inverting input of IC25 drops below the reference voltage generated by VR6, the output of IC25 becomes open. This open output of IC25 causes the base of transistor Q7 to become high due to the five volt supply connected through resistor R64 and transistor Q7 to conduct. With Q7 conducting, current flows through diode D18 and rapidly charges capacitor C20. This causes the noninverting input of comparator IC27 to go high with respect to the inverting input which is connected to the same bias network as the noninverting input of IC26 which provides about two and one half volts bias, so causes the output of IC27 to open and be pulled high by the positive twelve volt supply connected through resistor R65. Feedback capacitor C21 ensures a rapid switch from low to high output. This high output of IC27 is fed through capacitor C22, resistor R66, and connection ee to the inverting input of IC21 in current trip circuitry of FIG. 13. This causes the output of IC21 to go low and stop application of the high frequency square wave to the load. Capacitor C23 is a filter capacitor.

The high voltage on the emitter of transistor Q7, also now appears across resistor R63 and is fed through connection i or OR gate IC15 of the high frequency window generator circuitry of FIG. 8 causing the output of the OR gate to go high thereby stopping the application of the high frequency square wave to the load ballast. The high signal on the inverting input of IC26 is now higher than the bias voltage on the noninverting input and causes the output of IC26 to become low or grounded. This output connected through connection dd to the SCR control circuitry of FIG. 6 grounds capacitor C8 in that circuitry which prevents IC5 from producing a positive signal to trigger the A.C. signal to the load ballast. The high signal from transistor Q7 is also fed to the power monitor and relay driver circuitry of FIG. 16 through connection ff. The high output on IC25 is fed back through resistor R67 to the noninverting input of IC25 to increase the reference voltage on the noninverting input of IC25 slightly so that to restart operation of the circuitry, a higher illumination level has to be set than the lowest level prior to turning the circuitry off. This prevents on and off oscillation of the circuitry if the reference voltage is set right at the off reference level so that once off, the power remains off until the illumination setting is turned up slightly. When the illumination level reference voltage is increased so that it again becomes higher than the reference level set by VR6, the output of IC25 goes low which causes the bias voltage on the base of Q7 to drop and the transistor Q7 to stop conducting. This causes voltage on the inverting input of IC26 to drop below the voltage on the noninverting input and the output of IC26 to open, thereby allowing application of the phase controlled A.C. line voltage to the load ballast. This low signal is also sent through connection i to OR gate IC15 in the high frequency window generator circuitry of FIG. 8 to enable the high frequency signal. However, the high frequency signal is still blocked by the high output from IC27 which causes a low output from IC21, FIG. 13, which keeps the output of IC17, FIG. 9 high. When transistor Q7 stops conducting, diode D18 becomes reversed biased and capacitor C20 which provides a voltage to the noninverting input of IC27 discharges slowly through resistor R68, the discharge time being dependent upon the value of R68 and C20, and when the voltage on C20 drops below that on the inverting input (biased at about two and one half volts) the output of IC27 goes low which causes the output of IC21, FIG. 13 to go high to enable IC17, FIG. 9 to operate in normal fashion as described to allow application of the high frequency square wave to the load ballast. The delay caused by capacitor C20 allows the application of the phase controlled A.C. to the lamp ballast prior to the application of the high frequency signal, which is turned on later, after the set time delay.

Satisfactory component values for the circuitry of FIG. 15 are R58-10k ohms, R59-3.3k ohms, R60-1k ohms, R61-10k ohms, R63-1k ohms, R64-2k ohms, R65-100k ohms, R66-10k ohms, R67-100k ohms, R68-100k ohms, VR6-5k ohms, C20-2.2 microfarad, C21-0.1 microfarad, C22-0.1 microfarad, C23-0.001 microfarad, D17 and D18-1N914.

Figure 16:
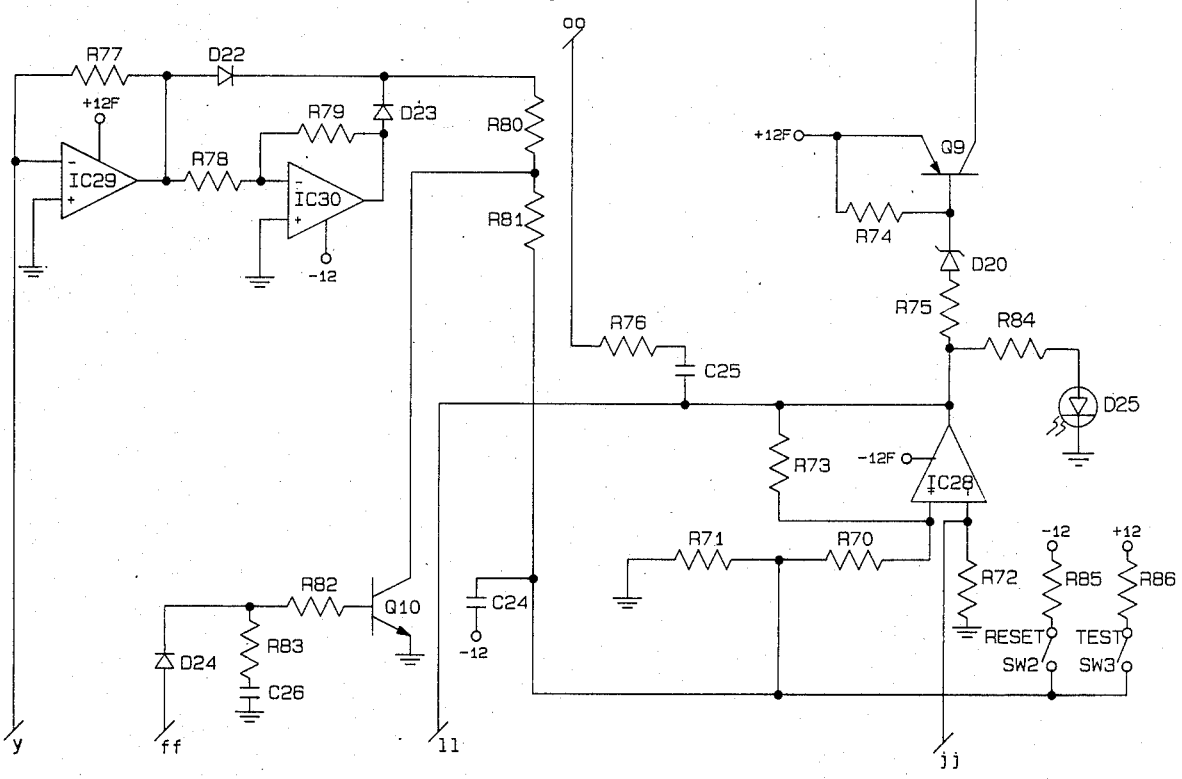

The power monitor and relay driver is shown in FIG. 16. The relay KR1 of the control and power circuitry of FIG. 12 is connected to the circuitry of FIG. 16 through connections gg and hh. The noninverting input of operational amplifier IC35 receives a voltage proportional to the rectified positive line voltage across capacitor C17 of FIG. 12 from the voltage divider made up of R54 and R55 of the high frequency amplitude and balance test circuitry of FIG. 14. This voltage from the divider of FIG. 14 is fed to IC35 through connection ii and appears at the noninverting input across capacitor C19. During normal operation of the circuitry, this input voltage is greater than the positive five volts connected to the inverting input of IC35 causing the output of IC35 to go high, in this case to a positive twelve volts. This causes a voltage drop across resistor R68, zener diode D19, and resistor R69. The voltage across resistor R68 brings the bias of transistor Q8 positive with respect to its emitter and causes it to conduct thereby connecting the negative twelve volt supply on its emitter to relay KR1 through connection hh. Upon initial start up of the circuitry, with no charge on capacitor C17 of the control and power circuitry of FIG. 12, the voltage from connection ii which is proportional to the voltage on capacitor C17 is low with respect to the five volt supply on the inverting input of IC35 causing the output of IC35 to be a negative twelve volts which keeps transistor Q8 in its nonconducting condition and relay KR1 deenergized. The voltage divider of R54 and R55 of FIG. 14 which supplies the input voltage to the noninverting input of IC35 through connection ii is set so that when capacitor C17 of FIG. 12 reaches about 87% of its full charge representing the full peak line voltage for the line with which the invention is used, it will cause the output of IC35 to change from low to high to cause transistor Q9 to conduct and relay KR1 to become engaged and apply the controlled signal to the load ballast. Also, if the voltage across capacitor C17 drops below this value during operation of the circuitry, indicating an abnormally low line voltage, the output of IC35 will become low and deenergize the relay, thereby disconnecting the circuitry of the invention from the load ballast.

To operate relay KR1, in addition to transistor Q8 being conductive to connect it to the negative supply, transistor Q9 must also be conductive to connect the other side of the relay to the positive twelve volt supply through connection gg. Upon start up of the circuitry, the noninverting input on operational amplifier IC28 is negative caused by capacitor C24 being connected to a negative twelve volt supply and supplying initially a negative voltage through resistors R70 and R71. This puts the noninverting input of IC28 negative with respect to the inverting input which is connected through resistor R72 to ground. The connection to the output of IC25 in the low level off circuitry of FIG. 15 through connection jj will also be grounded on start up. Thus, IC28 will give a negative output, in this case a negative twelve volt output, upon start up of the circuitry and this negative output will be latched into IC28 by reason of feedback resistor R73 which, during normal operation of the circuitry, will keep the noninverting input negative with respect to the inverting input.

The negative output of IC28 will cause a voltage drop from the positive twelve volt supply on the emitter of transistor Q9 through resistor R74, zener diode D20, and resistor R75. The voltage drop across R74 will cause the base of transistor Q9 to be negative with respect to the emitter and thereby cause Q9 to conduct and connect the relay KR1 of FIG. 12 to the positive supply through connection gg. Diode D21 prevents inductively produced voltages from the relay coil upon deenergization from exceeding the voltage ratings of transistors Q8 and Q9.

The output of IC28 is connected through capacitor C25, resistor R76 and connection oo to the inverting input of IC21 in the current trip circuitry of FIG. 13 and upon going low, supplies a negative pulse to IC21 to reset it to its positive output condition.

The circuitry of operational amplifiers IC29 and IC30, resistors R77, R78, and R79, and diodes D22 and D23 provides an error signal detection circuit, which, upon start up provides a low or ground signal at the junction of diodes D22 and D23 and, upon either a positive or negative signal on the inverting input of IC29 from connection y with the high frequency amplitude and balance test circuitry of FIG. 14, provides a positive output. As indicated in the description of the circuitry of FIG. 14, during normal operation, the voltage at the junction of resistor R50 and R51 which gives the voltage on connection y which appears on the inverting input to IC29 is approximately zero. This causes the output of IC29 to be about zero and the output of IC30 to be about zero. Because of diodes D22 and D23, the output at the junction of the diodes is zero. If the voltage on the inverting input of IC29 goes low because of an imbalance in the peak voltages of the square wave or because of a negative output of IC24 in FIG. 14, caused by the peak value of the high frequency square wave dropping significantly below the peak value of the line voltage or because of a sensed over current from the square wave, the output of IC29 goes high and the output of IC30 goes low. The low output of IC30 is blocked by doide D23 and the high output of IC 29 is passed by Diode D22 and a high output is fed through resistors R80 and R81 and then through R70 to the input of IC28 causing IC28 to go high and deenergize the relay. If the voltage on the inverting input of IC29 goes high because of imbalance of the square wave peaks, the output of IC29 goes low causing the output of IC30 to go high. Here the high output of IC30 is passed through diode D23 while the low output of IC29 is blocked by diodes D22 and again a positive output is sent to IC28 to cause deenergization of the relay.

Transistor Q10, resistors R82 and R83, capacitor C26 and diode D24 are provided to disable the error detection circuitry just described during a low level off condition. With the low level off as described in connection with the circuitry of FIG. 15, when the illumination level set by the user drops below a preset level, both the A.C. line voltage and the high frequency signal are disabled and not applied to the load ballast. In addition, as will be described in connection with the soft start circuitry of FIG. 17, upon start up of the circuitry and at other specified times, the A.C. line voltage will be applied to the load, but the high frequency signal will not be applied. In some instances, since capacitor C17 in the control and power circuitry maintains its charge, but since there is no high frequency output, the output of IC24 in the high frequency amplitude and balance test circuitry may go low giving an error signal. During this time, the transistor Q7 of FIG. 15 is conducting which supplies a positive voltage through connection ff, diode D24 and resistor R82 to the base of transistor Q10 in FIG. 16, thereby turning on the transistor and grounding out any error signal that may appear at the junction of diodes D22 and D23. This ensures that the output of IC28 stays low and relay KR1 stays engaged. Capacitor C26 and resistor R83 in conjunction with resistor R82 provide a slight delay in turning off transistor Q10 after the voltage on connection ff returns to its low level. As a second means to ensure that the relay remains energized during such times when the output of IC25 in FIG. 15 goes high, the high output is fed through connection jj to the inverting input of IC28 thereby ensuring that the output of IC28 stays low.

When the output of IC28 becomes high, indicating a circuit problem, the high output is fed through R84 and light emitting diode D25 which lights to give a visual indication of a circuit malfunction. A buzzer or the like could also be included to give an audible alarm.

Once an alarm condition has been sensed which has caused the output of IC28 to become high, the feedback resistor R73 insures that the output remains high and the relay deenergized until the circuitry is reset. The circuitry is reset by momentarily closing reset switch SW2. This connects the negative twelve volts supply through resistors R85 and R70 to the noninverting input of IC28 and causes its output to go low to energize the relay. To test the system, the test switch SW3 can be momentarily depressed which simulates an alarm condition by connecting the positive twelve volt supply through resistors R86 and R70 to the noninverting input of IC28 to cause its output to go high.

Satisfactory component values for the circuitry of FIG. 16 are R68-10k ohms, R69-5.1k ohms, R70-20k ohms, R71-200 ohms, R72-10k ohms, R73-150k ohms, R74-10k ohms, R75-5.1k ohms, R76-10k ohms, R77, R78, and R79-100k ohms, R80 and R81-510 ohms, R82 and R83-10k ohms, R84-2.7k ohms, R85 and R86-1k ohms, C19-4.7 microfarads, C24-1 microfarad, C25-0.1 microfarad, C26-10 microfarad, D19 and D20-1N4738, D21-1N5393, D22, D23, and D24-1N914.

It is generally desirable not to apply the high frequency during power up, power off, and relay operate and release activities of the circuitry. The soft start circuitry of FIG. 17 keeps the high frequency signal from being applied to the load ballast during these times.

Figure 17:
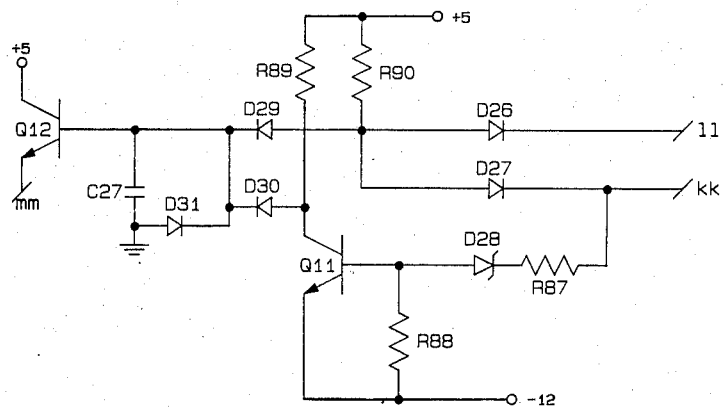

The circuitry of FIG. 17 comprised of diodes D26–D31, transistors Q11 and Q12 and resistors R87, R89, and R88 provides a logic function $\overline{P}+P.N$ where P is the output of IC35 of FIG. 16 and N is the output of IC28 of FIG. 16. Thus, transistor Q12 is turned "on" or conducts when the output of IC35 is low or when both the outputs of IC35 and IC28 are high. This represents the error conditions that results in deenergization of the relay. The output of IC35 is fed to the soft start circuitry of FIG. 17 through connection kk while the output of IC28 is fed to the circuitry through connection ll. During normal operation of the circuitry, the output of IC35 at connection kk is high and the output of IC28 at connection ll is low. The positive input at kk causes transistor Q11 to be forward biased and conduct from the five volt source through resistor R89 to thereby prevent a voltage from passing through diode D30 to the base of transistor Q12. The negative input at ll causes a voltage drop from the positive supply through resistor R90 and holds the junction between diodes D26 and D29 at a negative value. Transistor Q12 remains unbiased and in off or nonconducting condition. If the output of IC35 at kk goes low, Q11 looses its bias on the base and stops conducting. In this instance, the positive five volt source creates a positive voltage through diode D30 on the base of transistor Q12 and across capacitor C27 which biases the transistor to its "on" or conducting condition. If the output of IC35 is high, but the output of IC28 at ll also become high, although transistor Q11 is biased on by the positive voltage at kk as explained previously, the positive voltage at ll, although blocked by doide D26, allows the positive five volt supply through resistors R90 and diode D29, now forward biased, to create a positive bias on the base of transistor Q12 to cause it to conduct.

The collector of transistor Q12 is connected to the positive supply and the emitter is connected to the emitter of transistor Q7 of the low level off circuitry of FIG. 15 through connection mm. When transistor Q12 is in its "on" or conducting state it produces a high signal on the emitter of transistor Q7 to operate IC26 and IC27 to disconnect the high frequency signal as described in connection with the circuitry of FIG. 15.

Satisfactory component values for the circuitry of FIG. 17 are R87 through R90-10k ohms, D26, D27, D29, D30 and D31-1N914, D28-1N4738, C27-4.7 microfarad, Q11 and Q12-2N3569.

As mentioned earlier in connection with the SCR phase control circuitry of FIG. 6, the illumination level of the lights controlled by the circuitry of the invention may be set manually by setting variable resistor VR1 in the circuitry of FIG. 6, or may be controlled automatically by a voltage signal generated by a control circuit. The control circuit in most instances will be a light feedback control circuit where a desired level of illumination is manually set into the circuit and the actual illumination is sensed and the illumination of the lamps controlled to provide the preset illumination. This type of circuit is desireable because with fluorescent lamps, as the lamps get older, the luminance level decreases and dirt builds up which reduces the light output of the lamps. With a feedback circuit the desired level of illumination is set and as the light output of the lamps at a given power setting decreases, more power is fed to the lamps to compensate for this loss and keep the illumination level the same. Also, in some instances, supplemental sources of light, such as daylight, may enable the fluorescent lamp output to be decreased, saving energy, while still providing the same level of illumination in a room. FIG. 18 shows a preferred form of light feedback circuitry for use with the invention.

The light level in the room is sensed by photo resistor R91 which may be a Clairex type 5 MGM photoresistor. Typical photo resistive material has a logarithmic relationship between incident light and resistance. The particular photo resistor used here is typically three megohms at 0.01 footcandles illumination and 33 ohms at 1000 footcandles illumination. This relationship may be nearly linearized, more so for lower light intensities, by placing the photo resistor in the upper leg of a voltage divider since voltage at the junction of a divider is also a logarithmic function of the upper resistor. Thus, photoresistor R91 is connected as the upper resistor in a voltage divider made up of R91 and resistor R92 with photoresistor R91 connected to the emitter of transistor Q13 which supplies the voltage for the voltage divider. The voltage to the divider is adjustable by adjusting variable resistor VR7. The wiper of variable resistor VR7 is connected to provide the adjustable voltage to the noninverting input of operational amplifier IC31 which is connected as a comparator with its inverting input being the voltage output of transistor Q13. The output of IC31 is connected through resistor R93 to the base of transistor Q13 and provides the base bias to control the voltage at the emitter terminal which is supplied to the voltage divider. This voltage is adjusted under maximum controllable light conditions to provide a maximum voltage at the junction of R91 and R92 of about one half volt. This voltage is arbitrary, but is kept relatively low to minimize power losses.

The voltage at the junction of photoresistor R91 and resistor R92 is applied at the noninverting input to operational amplifier IC32.

The output of IC32 is connected through resistor R94 to the inverting input of operational amplifier IC33 connected as an integrator with capacitors C27 and C28. The noninverting input of IC33 comes through resistor R95 from a voltage divider made up of resistors R96 and R97 with the wiper of variable resistor VR8 serving as the voltage source. VR8 operates to set the desired illumination level which is then maintained by the circuitry. This desired level is represented by the voltage of the wiper of VR8.

Amplifier IC32 has a noninverting gain set by resistors R98, R99, and R100 sufficient to provide a maximum output at the inverting input of IC33 equal to the maximum control voltage that is provided by variable resistor VR8 to the noninverting input of IC33. The output of amplifier IC33 is a function of the difference voltage between the set voltage provided by a variable resistor VR8 and the voltage provided by amplifier IC32 which is proportional to the light sensed by photoresistor R91. The difference output of IC33 is connected through connection b to the SCR phase control circuitry of FIG. 6 and provides the automatically set reference voltage which controls the power applied to the load ballast and the light output of the controlled lamps. Thus, the light feedback control circuitry maintains the light at a level set by VR8 independent of other light sources or lamp aging.

In order to maintain calibration of the light feedback circuitry over the very large dynamic range of the photo resistor, the voltage at the junction of photoresistor R91 and resistor R92 is fed to the noninverting input of comparator IC34. The inverting input of IC34 is connected to a voltage divider made up of resistors R101 and R102 which is set equal to the maximum expected voltage at the noninverting input and to the output of IC34 through feedback capacitor C30. As this voltage is attained, the output of IC34 becomes high which causes current flow through resistor R103 and light emitting diode D32, and through resistors R104 and R105 to bias transistor Q14. The bias on transistor Q14 controls its conductivity which will lower the current supplied to the base of transistor Q13 and in turn lower the voltage applied to the photoresistor R91 so that the voltage at the junction of photoresistor R91 and resistor R92 does not exceed the maximum desired voltage.

Satisfactory component values for the circuitry of FIG. 18 are R92-150 ohms, R93-1k ohms, R94-3 mohm, R95-1 mohm, R96-20k ohms, R97-100k ohms, R98-100k ohms, R99-220k ohms, R100-10k ohms, R101-10k ohms, R102-470 ohms, R103-1k ohms, R104-10k ohms, R105-1k ohms, VR7-100k ohms, VR8-10k ohms, C27-0.047 microfarads, C28-4.7 microfarads, C30-0.1 microfarads, Q13 and Q14-2N3569.

While various components of the circuitry have been specified and various values have been given, it should be realized that these are provided as an example only and represent the best mode currently contemplated for carrying out the invention in actual practice but that various changes can be made. Also, with various integrated circuit components such as operational amplifiers and comparators, a number of such components may be contained in a single package.

It has been found with the circuitry as described, that substantially a full range of brightness can be obtained with fluorescent lamps using the circuitry of the invention and controlling the phase angle of the A.C. from about twenty degrees to about ninety degrees. The high frequency signal does have some effect on the total RMS value of voltage applied to the lamp and therefore, it has been found that full brightness of the lamps is obtained with about a 20 degree phase angle of A.C. as well as with the full A.C. to the lamps (zero phase angle).

A 16 kHz square wave as the high frequency signal has been described, and is presently preferred because the frequency is low enough that standard power transistors can be used to generate the signal, yet is high enough to be inaudible to the human ear so does not generate audible noise. In fact, the 16 kHz is close to the flyback frequency in television so people are use to ignoring it, if audible. However, high frequency signals down to about 1 kHz can be used since even at 1 kHz the signal is substantially blocked by the air gap in the ballast, and frequencies higher than 16 KHz can be used. Further, a high frequency square wave is easier to generate than other waveforms, but other waveforms such as a sinusoid may be used for the high frequency signal.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A dimmer for fluorescent lights that utilizes the standard ballast associated with the lights, comprising means for controlling the transmission of the normal line A.C. voltage sine wave to the ballast so that the A.C. voltage is connected to the ballast for only a selectable period of time during each half cycle of the sine wave and is blocked during the remaining period of each half cycle thereby controlling the power supplied to the discharge portion of the lights to control brightness; and means for applying a high frequency voltage signal to the ballast during at least a portion of the time period when the A.C. signal to the ballast is blocked thereby supplying additional power to the filaments of lights.

2. A dimmer for fluorescent lights according to claim 1, wherein the high frequency signal is in the form of a square wave.

3. A dimmer for fluorescent lights according to claim 2, wherein the high frequency square wave has a peak-to-peak voltage equal to the peak-to-peak voltage of the normal A.C. line voltage and has a fifty percent duty cycle.

4. A dimmer for fluorescent lights according to claim 3, wherein the frequency of the high frequency square wave is above about 1 KHz.

5. A dimmer for fluorescent lights according to claim 4, wherein the frequency of the high frequency square wave is about 16 KHz.

6. A dimmer for fluorescent lights according to claim 1, wherein the connection of the A.C. line voltage to the ballast is controlled by a semiconductor switch which blocks the A.C. line voltage from the ballast for a selectable period of time at the beginning of each half cycle of the sine wave and is then turned on to allow conduction of the A.C. line voltage to the ballast for the remainder of the half cycle of the sine wave.

7. A dimmer for fluorescent lights according to claim 6, wherein the period of time during which the semiconductor switch blocks the transmission of the A.C. line voltage to the ballast is determined by the time constant of a resistance-capacitance charging circuit which charges independently of the line A.C. voltage.

8. A dimmer for fluorescent lights according to claim 7, wherein the resistance and capacitance of the charging circuit is constant and the time during which the A.C. line voltage is blocked is selected by setting the charge on the capacitance at the beginning of each half cycle.

9. A dimmer for fluorescent lights according to claim 8, wherein the charge on the capacitance is determined by a manual adjustment.

10. A dimmer for fluorescent lights according to claim 8, wherein the charge on the capacitance is determined automatically by a control circuit.

11. A dimmer for fluorescent lights according to claim 10, wherein the control circuit monitors the light level in a room and controls the dimming of the lights to provide a constant set level of illumination.

12. A dimmer for fluorescent lights according to claim 1, wherein there is additionally included means to sense excessive current flow to the ballast during the period the high frequency signal is applied to the ballast and means to shut off the high frequency signal in response to sensed excessive current flow.

13. A dimmer for fluorescent lights according to claim 1, wherein there is additionally included means to sense and compare the value of the positive and negative peak voltages of the high frequency signal and means to shut off the high frequency signal in response to a preset level of imbalance sensed between the positive and negative peak values.

14. A dimmer for fluorescent lights according to claim 1, where there is additionally included means to monitor the value of the line voltage and means to shut off the dimmer if the line voltage drops below a preset level.

15. A dimmer for fluorescent lights according to claim 1, wherein there is additionally included means to connect the lights directly to the A.C. line in the event of a failure of the dimmer.

16. A dimmer for fluorescent lights according to claim 1, wherein there is additionally included means to detect faults within the dimmer and means to disconnect the dimmer and connect the lights directly to the A.C. line in the event of a sensed fault.

17. A dimmer for fluorescent lights according to claim 1, wherein there is additionally included means to shut off all signals to the ballast when the signals that would otherwise be provided to the ballast by the dimmer would provide an illumination level of the lights below a present minimum.

18. A dimmer for fluorescent lights according to claim 1, wherein there is additionally included means to delay application of the high frequency signal to the ballast for a preset period after first applying the controlled A.C. signal to the ballast.

19. A dimmer for fluorescent lights according to claim 1, wherein there is additionally included means to insure that each time the high frequency signal is applied to the ballast, the signal starts at the beginning of a half cycle of the high frequency signal.

20. A dimmer for fluorescent lights according to claim 1, wherein the periods during which the A.C. line signal is blocked and during which it is applied to the ballast thereby controlling the illumination of the lights is controlled by a manual adjustment.

21. A dimmer for fluorescent lights according to claim 1, wherein the periods during which the A.C. line signal is blocked and during which it is applied to the ballast thereby controlling the illumination of the lights is controlled automatically by means sensing the light level in a room and controlling the dimmer to maintain a constact present illumination level.

* * * * *